US009199478B2

(12) United States Patent
Suzuki et al.

(10) Patent No.: US 9,199,478 B2
(45) Date of Patent: Dec. 1, 2015

(54) LIQUID EJECTION APPARATUS INCLUDING A LIQUID SUPPLY TUBE

(71) Applicant: SEIKO EPSON CORPORATION, Tokyo (JP)

(72) Inventors: Yuto Suzuki, Shiojiri (JP); Nobuhisa Nomoto, Matsumoto (JP); Masaki Shimomura, Matsumoto (JP); Nobutaka Suzuki, Shiojiri (JP); Seiji Tezuka, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/962,499

(22) Filed: Aug. 8, 2013

(65) Prior Publication Data

US 2014/0043409 A1 Feb. 13, 2014

(30) Foreign Application Priority Data

Aug. 10, 2012 (JP) ..... 2012-178013
Aug. 10, 2012 (JP) ..... 2012-178151
Aug. 10, 2012 (JP) ..... 2012-178154

(51) Int. Cl.
*B41J 2/17* (2006.01)
*B41J 2/175* (2006.01)
*B41J 29/02* (2006.01)

(52) U.S. Cl.
CPC ..... *B41J 2/17553* (2013.01); *B41J 2/17509* (2013.01); *B41J 29/02* (2013.01)

(58) Field of Classification Search
USPC ..... 347/84–86
See application file for complete search history.

(56) References Cited

U.S. PATENT DOCUMENTS

| | | | | |
|---|---|---|---|---|
| 7,920,373 | B2 * | 4/2011 | Matsubara | 361/679.01 |
| 2001/0026304 | A1 * | 10/2001 | Matsuzaki et al. | 347/85 |
| 2004/0125181 | A1 * | 7/2004 | Nakamura | 347/85 |
| 2006/0284945 | A1 * | 12/2006 | Kobayashi et al. | 347/85 |
| 2007/0146445 | A1 * | 6/2007 | Nukui et al. | 347/85 |
| 2008/0074457 | A1 | 3/2008 | Okuda | |
| 2008/0286002 | A1 * | 11/2008 | Akiyama | 399/114 |
| 2008/0315500 | A1 * | 12/2008 | Takasaka et al. | 271/109 |
| 2010/0128092 | A1 * | 5/2010 | Nakamura | 347/85 |
| 2011/0018947 | A1 * | 1/2011 | Kobayashi | 347/85 |
| 2011/0242249 | A1 | 10/2011 | Yazawa | |
| 2012/0044308 | A1 * | 2/2012 | Kobayashi | 347/104 |
| 2012/0154486 | A1 * | 6/2012 | Anderson et al. | 347/40 |

FOREIGN PATENT DOCUMENTS

| | | |
|---|---|---|
| CN | 2825289 | 10/2006 |
| JP | 2008-105388 | 5/2008 |
| JP | 2010-100067 | 5/2010 |
| JP | 2011-207039 | 10/2011 |
| JP | 2012-076224 | 4/2012 |
| TW | 538909 | 6/2003 |

* cited by examiner

*Primary Examiner* — Stephen Meier
*Assistant Examiner* — Sharon A Polk
(74) *Attorney, Agent, or Firm* — Workman Nydegger

(57) ABSTRACT

A liquid ejection apparatus includes a cover unit that is movable relative to a housing, an ink tank provided outside the housing in a state containing ink, a ink supplying tube in which ink can flow so that ink is supplied from the ink tank to the liquid ejection head, and an insertion hole that allows the ink supplying tube to be inserted into the housing, wherein the housing is formed by a housing portion in which a container that houses a stacker is formed to protrude, and a housing portion which has an operation panel having an inclined surface which protrudes at a position above the container, and the insertion hole is provided on at least one of the housing and the cover unit.

17 Claims, 17 Drawing Sheets

LIQUID EJECTION APPARATUS INCLUDING A LIQUID SUPPLY TUBE

BACKGROUND

1. Technical Field

The present invention relates to liquid ejection apparatuses that eject liquid onto a target.

2. Related Art

Ink jet printers are known as a type of liquid ejection apparatus that performs printing (recording) by ejecting ink from a liquid ejection head onto a target such as a sheet of paper. CN2825289Y discloses a printer, in which ink is supplied from ink tanks which store a relatively large volume of ink to ink cartridges via ink supplying tubes so that ink is continuously supplied to a liquid ejection head in a stable manner when performing a relatively large volume printing.

In such a printer, the liquid ejection head is mounted on a carriage so as to reciprocate in a main scan direction of the paper sheet in an apparatus housing. The ink supplying tubes extend from the ink tanks which are provided outside of the apparatus housing to a movement area of the carriage through an opening which is formed at the upper position of the apparatus housing and is connected to the ink cartridges which is mounted on the carriage.

In the above printer, a cover member (cover) is provided on the housing (apparatus housing) so as to openably close the opening. A spacer is disposed at a position interposed between the cover member and the housing when the cover member is at a closed position for closing the opening. The spacer forms a gap between the cover member and the periphery of the opening so that the ink supplying tubes are inserted through the gap. Since the gap between the opening of the housing and the cover member is not completely closed due to the spacer, there is a risk that dust may enter the movement area of the carriage through the gap from the outside of the housing.

SUMMARY

An advantage of some aspects of the invention is that a liquid ejection apparatus which is capable of closing the cover member on the housing while allowing for the flow of liquid from the liquid container which is disposed outside the housing to a liquid ejection head which is disposed inside the housing is provided.

According to an aspect of the invention, a liquid ejection apparatus includes a liquid ejection head that ejects liquid onto a target; a housing in which a carriage having the liquid ejection head is disposed in a mobavle manner and an opening is formed so that at least part of a movement area of the carriage is exposed through the opening; a cover member that is movable relative to the housing; a liquid container provided outside the housing in a state containing the liquid; a liquid supplying tube in which the liquid can flow so that the liquid is supplied from the liquid container to the liquid ejection head; and an insertion section that allows the liquid supplying tube to be inserted into the housing, wherein the housing is formed by a housing portion in which a tray housing unit is formed to protrude in an ejection direction of the target, the tray housing unit housing an ejection tray for receiving the target ejected from the housing in a drawable manner, and a housing portion which has an operation panel used for operation which is provided above the tray housing unit and has an inclined surface whose lower end extends farther in the ejection direction than the upper end does, and the insertion section is provided on at least one of the housing and the cover member.

With this configuration, even if the cover member is placed to close opening of the housing, the liquid supplying tube can be inserted into the opening of the housing through the insertion section provided on at least one of the housing and the cover member so that the liquid is supplied to the carriage which is disposed inside the housing. Accordingly, the cover member can be remained to close the opening of the housing while ink is supplied, for example, from the liquid container which is provided outside the housing to the liquid ejection head which is provided inside the housing.

According to the above aspect of the invention, the liquid ejection apparatus further includes a feeding cassette unit that is capable of storing the target and is removably housed in the housing portion that is formed to protrude in the ejection direction of the target such that the feeding cassette unit is disposed to protrude in the ejection direction with the housing portion.

With this configuration, the liquid ejection apparatus is prevented from being increased in size.

According to the above aspect of the invention, in the liquid ejection apparatus, the insertion section is provided at a recess that is formed on at least one of the housing and the cover member.

With this configuration, when the liquid supplying tube is inserted into the insertion section, the recess allows the liquid supplying tube to be easily guided into the insertion section.

According to the above aspect of the invention, in the liquid ejection apparatus, a projection is formed on the other of the housing and the cover member at a position that opposes the recess formed on the one of the housing and the cover member when the cover member is displaced from a position to open the opening to a position to close the opening, and the insertion section is provided between the projection and the recess.

With this configuration, when the cover member is placed to close the opening of the housing, the liquid supplying tube can be stably positioned in the insertion section by inserting the liquid supplying tube between the projection and the recess.

According to the above aspect of the invention, in the liquid ejection apparatus, the insertion section is provided on at least one of the housing and the cover member on a side face at one end in the movement direction of the carriage.

With this configuration, since the longitudinal direction of the liquid supplying tube inserted through the insertion section can be the direction along the movement direction of the carriage, the length of the tube necessary for supplying the liquid to the moving carriage can be easily inserted into the housing.

According to the above aspect of the invention, in the liquid ejection apparatus, the insertion section is provided on the surface of the housing on which an ejection port for the target is disposed.

With this configuration, routing of the liquid supplying tube can be performed relatively easy.

According to the above aspect of the invention, in the liquid ejection apparatus, the liquid supplying tube is inserted into a housing gap that is formed on at least one of the housing and the cover member so as to communicate with the opening when the cover member is displaced from the position to open the opening to the position to close the opening.

With this configuration, even if the cover member is placed to close the opening of the housing, the liquid supplying tube can be inserted into the opening of the housing through the housing gap which is formed on at least one of the housing and the cover member so that the liquid can be supplied to the carriage provided inside the housing. Accordingly, the cover member can be remained to close the opening of the housing while the liquid is supplied, for example, from the liquid container which is provided outside the housing to the liquid ejection head mounted on the carriage which is provided inside the housing.

According to the above aspect of the invention, in the liquid ejection apparatus, the cover member is stacked on the housing when the cover member is placed to close the opening, and a grip is provided on at least one of the housing and the cover member, the grip being configured to be gripped by a user with his/her hand to lift the cover member so as to open the opening, and the housing gap is provided at a position of the grip.

With this configuration, the liquid supplying tube can be easily guided to the opening by inserting the liquid supplying tube into the housing gap formed at the grip which is configured to be gripped by the user with his/her hand to lift the cover member.

According to the above aspect of the invention, in the liquid ejection apparatus, the grip is formed as a recessed shape on both the housing and the cover member so that each of the recessed shapes communicate with each other when the cover member is displaced to the position to close the opening.

With this configuration, even if the liquid supplying tube is inserted into the grip, the cover member can be easily lifted by using the grip since the grip has a wide space area when the cover member is placed to close the opening of the housing.

According to the above aspect of the invention, in the liquid ejection apparatus, the cover member includes a scanner mechanism.

With this configuration, it is possible to achieve the liquid ejection apparatus having multiple functions while the liquid ejection apparatus is capable of supplying the liquid, for example, from the liquid container provided outside the housing to the liquid ejection head mounted on the carriage which is provided inside the housing by providing the scanner unit in the displaceable cover member.

According to the above aspect of the invention, in the liquid ejection apparatus, the liquid supplying tube is formed by a plurality of tubes connected by a joint that connects the tubes.

With this configuration, the liquid supplying tube can be adjusted to an appropriate length for routing of the liquid supplying tube by connecting the plurality of tubes.

According to the above aspect of the invention, in the liquid ejection apparatus, one liquid supplying tube or a plurality of liquid supplying tubes are provided.

With this configuration, the liquid can be supplied from each of the liquid ejection head via the number of liquid supplying tube which corresponds to the number of the liquid containers.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

An ink jet printer will be described below as a first embodiment of a liquid ejection apparatus with reference to the drawings. The ink jet printer includes a liquid ejection head that is configured to eject ink which is an example of liquid and performs printing of images including texts and graphics by ejecting ink onto a sheet of paper which is an example of target.

Figure 1:
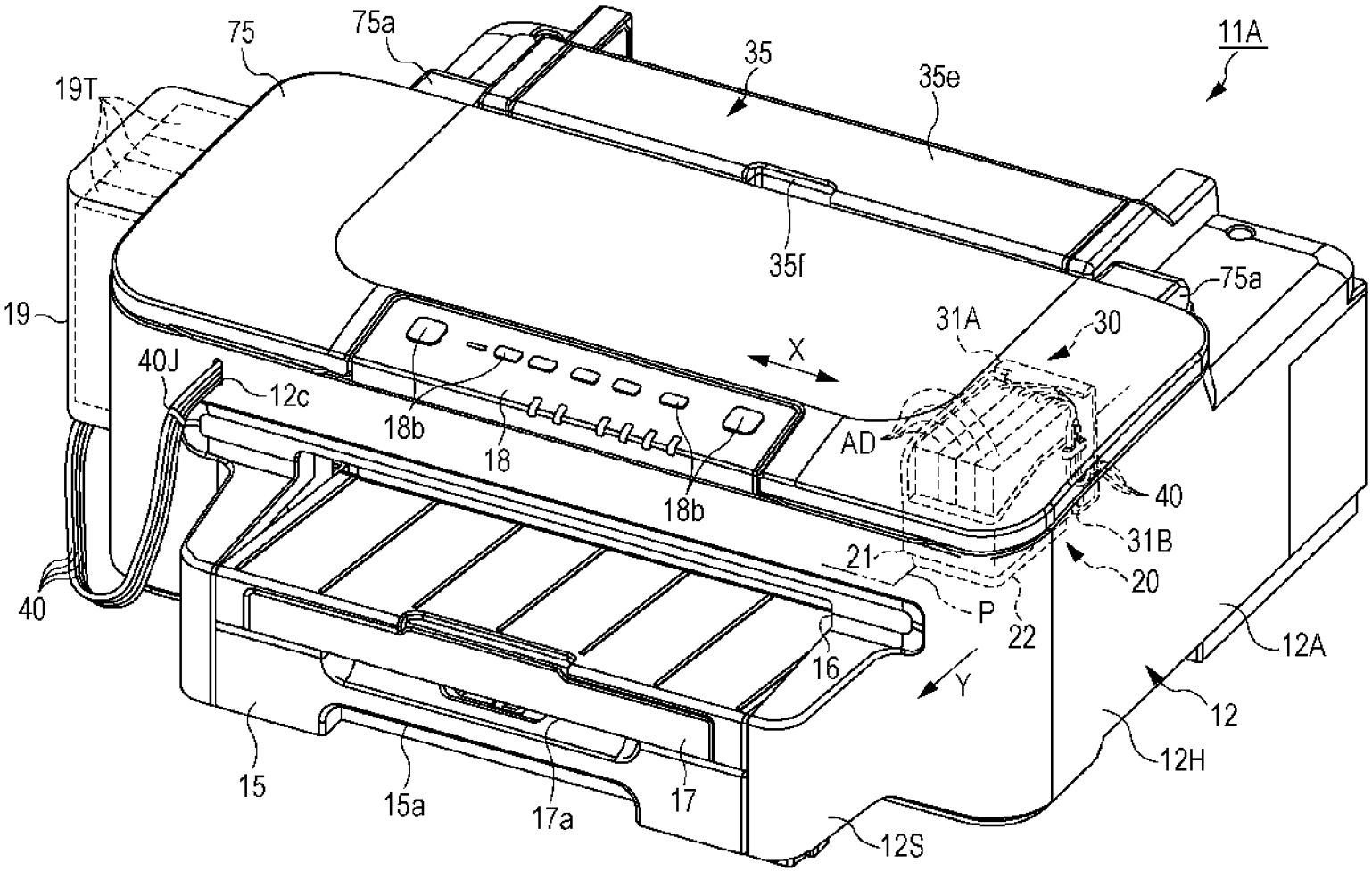
FIG. 1 is a perspective view of a printer according to a first embodiment of the invention.

As shown in FIG. 1, a printer 11A according to this embodiment includes a printer unit 12A having a printing function which is formed by an apparatus body 12 and a cover unit 75 which is disposed on the upper side of the apparatus body 12. The printer 11A includes the apparatus body 12 formed in a substantially cuboid shape and ink tanks 19T as an example of liquid container which are formed in a substantially cuboid shape and are provided separately from the apparatus body 12. In the printer 11A, ink is supplied from the ink tanks 19T which are provided outside the apparatus body 12 and flows ink supplying tubes 40 which are inserted into a housing 12H to a liquid ejection head 22 via adapters AD which are mounted on a carriage 21 in the apparatus body 12.

The apparatus body 12 which receives the supplied ink includes the housing 12H which is provided with a printing section 20. The cover unit 75 is provided as an example of cover member and is rotatable (movable) about a hinge 75*a* disposed on one end (back side) of the apparatus body 12 so that the front end of the cover unit 75 which is located opposite of the hinge 75*a* (the front side in FIG. 3) is lifted from the apparatus body 12. The cover unit 75 can be lifted by a user, for example during maintenance of the printer 11A. When the cover is lifted, an opening 12K (see FIG. 3) which is disposed at an upper position of the printing section 20 is uncovered so that at least part of a movement area of the carriage 21 which is movable in a reciprocating manner in the printer unit 12A is exposed through the opening 12K.

A manual sheet feeding mechanism 35 is disposed on the back side of the cover unit 75 in the apparatus body 12. The manual sheet feeding mechanism 35 has a cover 35*e* which also serves as a sheet feeding tray 35*a* (see FIG. 2). The cover 35*e* is rotatable about the back end thereof so as to move between open and closed positions and is held at the closed position when not in use as shown in FIG. 1. A recessed grip 35*f* is formed on the front end of the cover 35*e* in its closed position. When in use, the user can grip the grip 35*f* to rotate the cover 35*e* backward to the open position in which the sheet feeding tray 35*a* is obliquely raised (see FIG. 2). The configuration of the manual sheet feeding mechanism 35 at the open position will be described later.

Further, a sheet feeding cassette 15 that is capable of storing a plurality of stacked paper sheets P is detachably mounted in the lower position of the apparatus body 12. The paper sheets P stored in the sheet feeding cassette 15 are fed out one by one in the forward direction to the printing section 20 which is provided in the printer unit 12A so that printing is performed on the fed out paper sheet P in the printing section 20. After printing is performed in the printing section 20, the paper sheet P is ejected from an ejection port 16 which is disposed on the front face of the apparatus body 12 (printer unit 12A).

A stacker 17 which is an example of ejection tray is housed in the apparatus body 12 (printer unit 12A) at a position above the sheet feeding cassette 15 and under the ejection port 16. When in use, the stacker 17 is pulled out from the apparatus body 12 in an ejection direction (transportation direction) of the paper sheet P by an amount corresponding to a length of the paper sheet P.

A container 12S is formed by a housing portion which protrudes in the ejection direction of the paper sheet P (in this embodiment, a sub-scan direction Y). The sheet feeding cassette 15 and the stacker 17 are housed in a housing recess which is disposed at the center of the container 12S in the width direction. The container 12S protrudes in the sub-scan direction Y, since a length of the sheet feeding cassette 15 in the sub-scan direction Y which is necessary for the printing section 20 is longer than a length of the housing 12H in the sub-scan direction. Accordingly, the sheet feeding cassette 15 and the stacker 17 are housed in the state that they protrude from the apparatus body 12 in the sub-scan direction Y (forward direction) with the front end faces of the sheet feeding cassette 15 and the stacker 17 being flush with the container 12S. More specifically, if the length of the apparatus body 12 in the sub-scan direction Y is determined based on the length of the sheet feeding cassette 15 in the sub-scan direction Y which is necessary for storing the paper sheets P of a predetermined size (for example, A4 size), it leads to increase in the size (footprint) of the apparatus body 12. In order to avoid this problem as much as possible, only the containing portion of the sheet feeding cassette 15 is formed to protrude from the apparatus body 12. Further, since the front face of the stacker 17 in the housed state is positioned to be flush with the protruding front face of the sheet feeding cassette 15, a protruding length of the stacker 17 when pulled out becomes relatively large. Moreover, due to this protruding shape, the stacker 17 can be easily pulled out from the apparatus body 12 by gripping a grip 17*a*. As a result, the printer 11A is prevented from increasing in size (particularly, footprint) regardless of its configuration that the sheet feeding cassette 15 is detachably mounted on the front face of the apparatus body 12 and sheet feeding can be performed from the front side of the apparatus body 12. In this embodiment, the container 12S and the sheet feeding cassette 15 constitute an example of the feeding cassette unit.

As shown in FIG. 1, an operation panel 18 is disposed on the apparatus body 12 (printer unit 12A) so that the printing section 20 performs various operations such as a printing operation. The operation panel 18 is formed by a housing portion having an inclined surface whose lower end extends farther in the ejection direction of the paper sheet P (that is, the sub-scan direction Y) than the upper end does. Operation buttons 18*b* are disposed on the inclined surface of the operation panel 18. The operation buttons 18*b* may include a power button and a print start button. Since the operation surface of the operation panel 18 is inclined downward in the forward direction, the user has a good operability of the operation buttons 18*b*. A recess 75*b* is formed on a distal end side of the rotatable cover unit 75 at a position which corresponds to the operation panel 18 so that the cover unit 75 does not interfere with the operation panel 18 when the cover unit 75 is closed.

The printing section 20 in the printer 11A of this embodiment includes the carriage 21 which is an example of moving member that reciprocates in a main scan direction X, and the liquid ejection head 22 that ejects ink is mounted on the carriage 21. The carriage 21 can move (reciprocate) in the main scan direction X when guided by a guide frame 30 which is a plate member that extends in the main scan direction X. The guide frame 30 includes an upper rail 31A and a lower rail 31B which are formed by bending the member in a substantially U-shape at the upper and lower ends on each side of the plate member which extends perpendicular to the main scan direction X. The carriage 21 reciprocates in the main scan direction X with the back end of the carriage 21 being supported by the upper rail 31A and the lower rail 31B. When ink is supplied from the ink supplying tubes 40 to the liquid ejection head 22 which is mounted on the reciprocating carriage 21, ink is ejected from the liquid ejection head 22, thereby performing printing on the paper sheet P.

The carriage 21 is in a substantially rectangular box shape having an open upper end. Adapters AD are mounted in the recessed mounting area at an upper position of the carriage 21 so as to allow ink which is supplied from the ink supplying tubes 40 to flow to the liquid ejection head 22. Accordingly, ink is supplied to the liquid ejection head 22 via the adapters AD mounted in the carriage 21. As a consequence, when the ink supplying tubes 40 are connected to the adapters AD so as to supply ink in the ink tanks 19T, the ink supplying tubes 40 form the ink flow paths so that ink flows from the ink tanks 19T to the liquid ejection head 22.

The printer 11A of this embodiment is available for color printing. In the example shown in FIG. 1, the adapters AD of the same number (for example, four) as that of ink colors necessary for color printing (for example, four colors) are provided. As a matter of course, the printer 11A can be used as a monochrome printer by mounting only the adapter AD for black color. Further, the carriage 21 can be used with the ink cartridges. Accordingly, the adapters AD have a rectangular plate shape which corresponds to the shape and size of the ink cartridges used for the printer 11A. Since the volume of ink for the adapters AD may be smaller than that of the ink cartridges, the shape and size of the adapters AD may be modified as appropriate as long as the adapters AD can be mounted in the mounting area of the carriage 21.

The printer 11A can also perform printing of the data received from a host device via USB communication or the image data such as photographs read out from a memory card.

Figure 2:
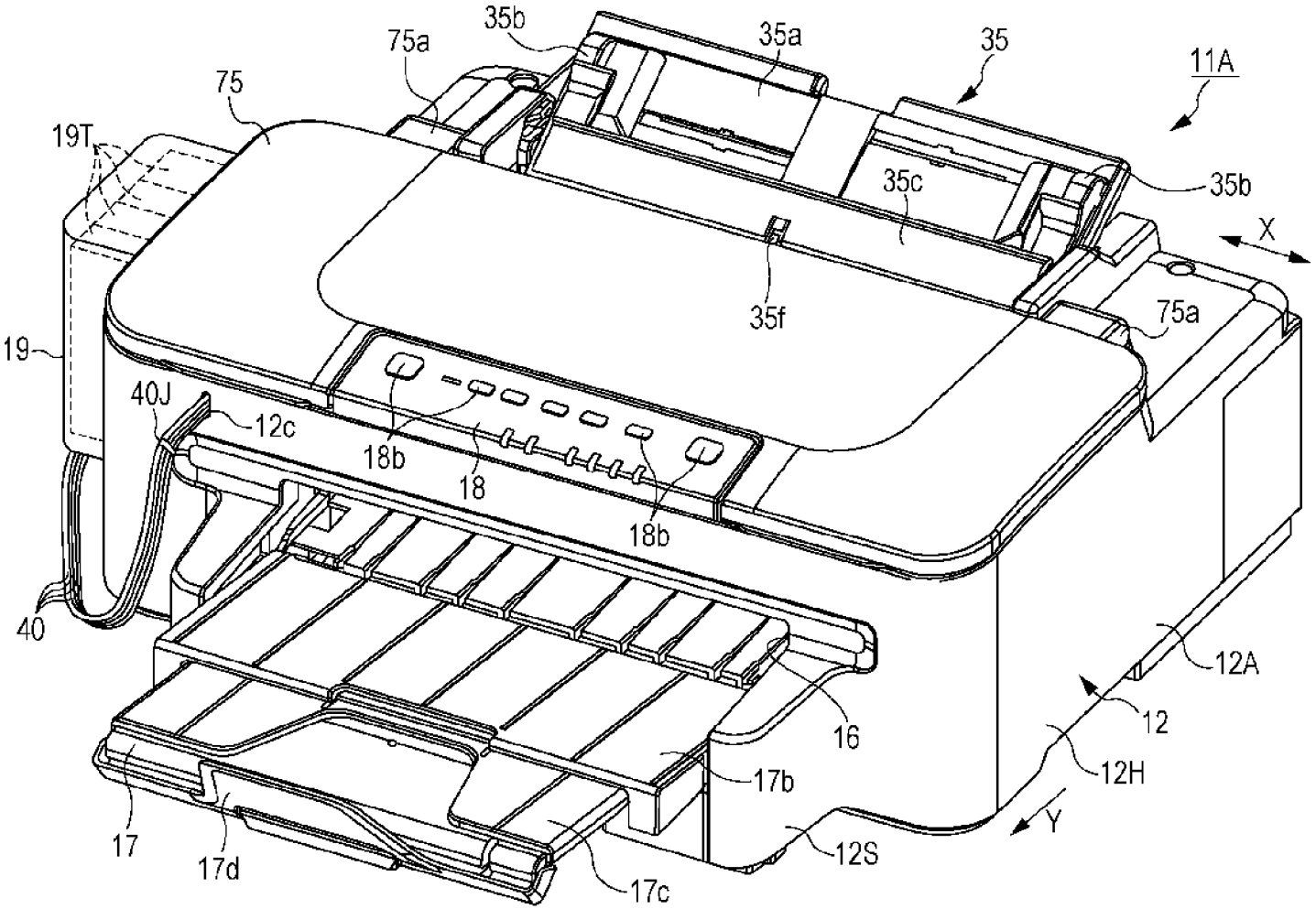
FIG. 2 is a perspective view of the printer showing that a stacker and a manual sheet feeding mechanism are open.

FIG. 2 shows the printer 11A in which the stacker 17 and the manual sheet feeding mechanism 35 are at open position. As shown in FIG. 2, the manual sheet feeding mechanism 35 is disposed on the back side of the apparatus body 12 (printer unit 12A). The manual sheet feeding mechanism 35 is a mechanism to feed one paper sheet P manually set by a user. The manual sheet feeding mechanism 35 includes a sheet feeding tray 35*a* having a substantially rectangular shape, a pair of sheet guides 35*b* for positioning the paper sheet P in the width direction on the sheet feeding tray 35*a*, and a protective plate 35*c* for preventing foreign matters from entering through a feeding port (not shown) when the manual sheet feeding mechanism 35 is at the open position. The sheet feeding tray 35*a* is rotatable about its proximal end (lower end in FIG. 2) within a predetermined angle range and moves between the open position in which the paper sheets P can be set on the inclined sheet feeding tray 35*a* as shown in FIG. 2 and the closed position in which the sheet feeding tray 35*a* is rotated forward from the state shown in FIG. 2 so as to be housed in the apparatus body 12. The protective plate 35*c* is biased toward the sheet feeding tray 35*a* by an elastic force of a torsion coil spring (not shown). When the sheet feeding tray 35*a* is open, the protective plate 35*c* is positioned at a protective position as shown in FIG. 2 so that the protective plate 35*c* prevents foreign matters from entering through the feeding port.

As shown in FIG. 2, for example, the stacker 17 is a three-stage type having a first tray 17*b*, a second tray 17*c* and a third tray 17*d*. The first tray 17*b* is slidably attached to the apparatus body 12, and the second tray 17*c* is slidably attached to the first tray 17*b*. The third tray 17*d* is rotatably attached to the distal end of the second tray 17*c* so as to move between a closed position in which the third tray 17*d* is housed by being folded over the second tray 17*c* and an open position in which the third tray 17*d* is open forward at a predetermined angle as shown in FIG. 2 so as to serve as a stopper for the paper sheets P.

Figure 3:
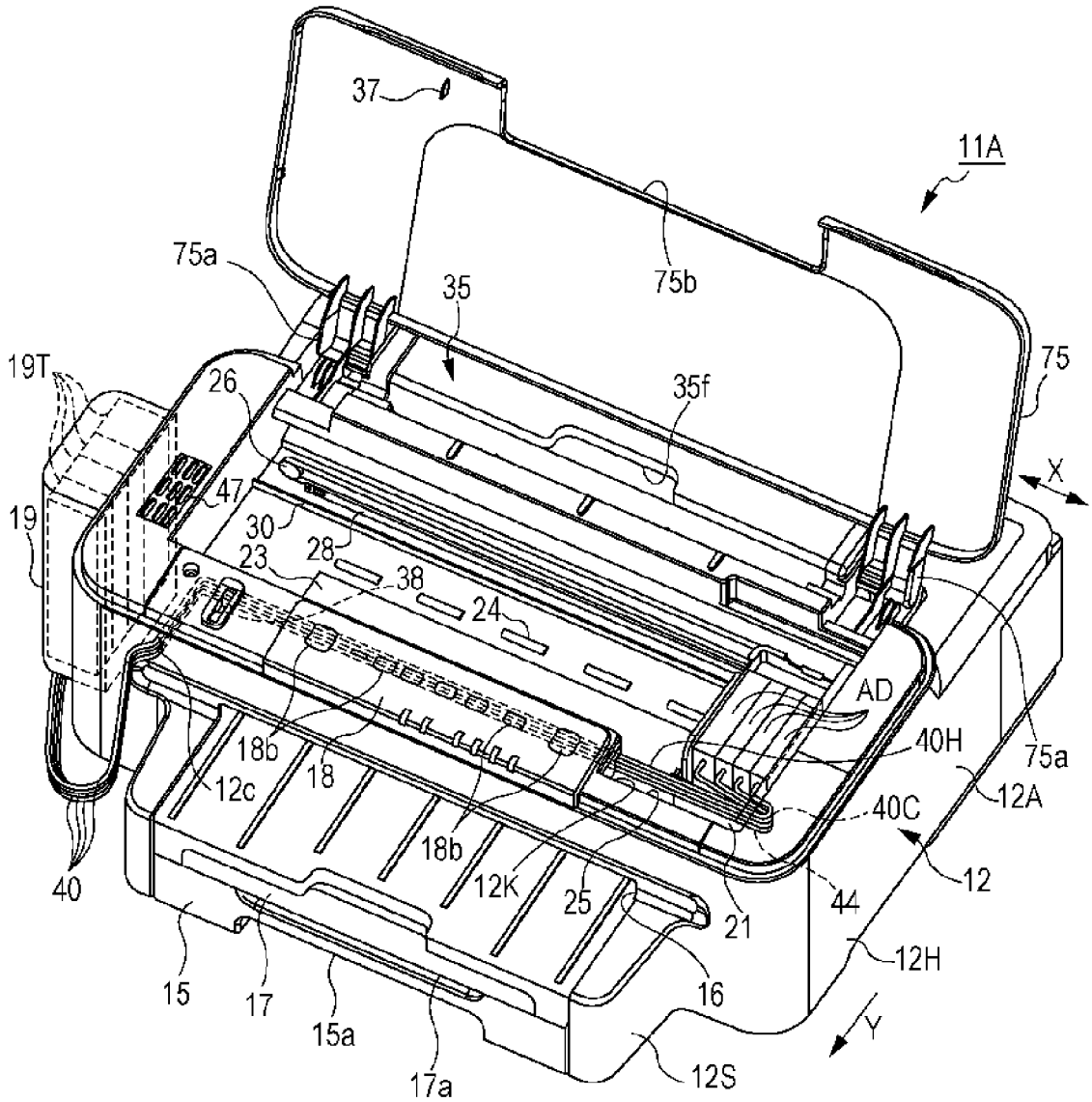
FIG. 3 is a perspective view of the printer showing that a cover is open.

As shown in FIG. 3, a detection projection 37 is formed on the back surface of the cover unit 75 at a position close to the distal end side and on the left side in the width direction. When the cover unit 75 is closed, the projection 37 is inserted into a detection recess 38 which is formed on the upper surface of the apparatus body 12. A sensor 39 (see FIG. 4) as an example of sensing unit that senses the projection 37 inserted into the detection recess 38 is disposed in the apparatus body 12 at a position which corresponds to the detection recess 38. A controller C (see FIG. 4) as an example of control unit in the printer 11A is configured to start a printing operation to perform a print instruction when the sensor 39 senses that the cover unit 75 is at the closed position, and not to start a printing operation when the sensor 39 does not sense the cover unit 75 at the closed position regardless of a print instruction.

As shown in FIG. 3, an elongated support table 23 which extends in the main scan direction X is disposed in the housing 12H so as to oppose the underside (nozzle forming surface) of the liquid ejection head 22 (see FIG. 1) which is mounted on the underside of the carriage 21. Transportation rollers 24 and an ejection roller 25 are disposed at positions upstream and downstream relative to the support table 23 in the sub-scan direction Y, respectively. A pick-up roller, which is not shown, is configured to abut against the upper surface of the paper sheets P which are stored in the sheet feeding cassette 15. As the pick-up roller rotates, the uppermost paper sheet P is fed out backward. The fed out paper sheet P is then turned around a feed roller (not shown) and is fed in the reversed direction which is the sub-scan direction Y. When the paper sheet P reaches the transportation rollers 24, the paper sheet P is fed onto the support table 23 by rotation of the transportation rollers 24.

Further, an endless timing belt 27 is wound around a pair of pulleys 26 along the guide frame 30 which is disposed on the back side of the carriage 21 in the housing 12H, and the back side of the carriage 21 is fixedly attached on part of the timing belt 27. A linear encoder 28 is disposed under the timing belt 27 so as to extend parallel to the timing belt 27 such that the position of the carriage 21 is detected based on the detection signal from the linear encoder 28.

One of the pair of pulleys 26 is connected to an output shaft of a carriage motor, which is not shown. The carriage 21 reciprocates in the main scan direction X along the rails 31A, 31B when the timing belt 27 rotates forward and backward by driving the carriage motor forward and backward. Then, printing of texts and images onto the paper sheet P is performed by alternatively repeating a recording operation in which recording for one line (one path) is performed by the liquid ejection head 22 ejecting ink onto the paper sheet P while the carriage 21 moves and a transportation operation in which the paper sheet P is transported to the next recording position. Ejection of ink from the nozzles of the liquid ejection head 22 is controlled for each ink color according to the position of the carriage, which is detected based on the detection signal of the linear encoder 28.

Ink used for printing by the liquid ejection head 22 is supplied from the ink tanks 19T in an external tank unit 19 to the liquid ejection head 22 via the ink supplying tubes 40 and the adapters AD. The tank unit 19 of this embodiment houses, for example, four ink tanks 19T containing four different ink colors. Those four colors may be, for example, black (K), cyan (C), magenta (M), and yellow (Y). In the example shown in FIG. 3, one of the ink tanks 19T for containing black ink whose consumption is relatively large is a large tank having a larger width, and the remaining three ink tanks 19T for containing ink of three colors are small tanks having a slightly smaller width.

The adapters AD which are configured to mount on the carriage 21 also include one adapter AD having a larger width for black ink and three adapters AD having a smaller width for ink of three colors, according to the shape and size of the corresponding ink cartridge for each ink color. The carriage 21 has a plurality of recesses for the ink cartridges. When the adapters AD are mounted in the recesses, terminals on the back side of the adapters AD are connected to terminals on the carriage 21.

As shown in FIG. 3, the ink tanks 19T housed in the tank unit 19 are disposed outside the apparatus body 12. The ink tanks 19T are positioned on the left outside of the housing 12H when seen from the front side of the printer 11A (downstream side in the sub-scan direction Y), that is, at a position opposite of the home position in the main scan direction X. The ink supplying tubes 40, one end of which is connected to each of the ink tanks 19T, are inserted into the apparatus body 12 through an insertion hole 12*c* which is formed on the front face of the apparatus body 12. As shown in FIGS. 1 and 2, a plurality of ink supplying tubes 40 are formed by connecting a plurality of tubes via a joint 40J. Although the plurality of ink supplying tubes 40 are connected by the joint 40J at a position between the tank unit 19 and the printer 11A in the example shown in FIGS. 1 and 2, the ink supplying tubes 40 may be connected by the joint at a position inside the housing 12H.

As shown in FIG. 3, the plurality of ink supplying tubes 40 inserted into the apparatus body 12 are routed in the main scan direction X along a flexible flat cable 60. The other end of the ink supplying tubes 40 located downstream in the ink supplying direction is connected to the adapters AD which are mounted on the carriage 21. More specifically, outlet tubes (not shown) are formed on the bottom of the tank unit 19 so as to communicate with the ink tanks 19T and are connected to one end of the ink supplying tubes 40. The other end of the ink supplying tubes 40 which are routed in the housing 12H are connected to supplying tubes (not shown) formed on the upper side of the adapters AD which are mounted on the carriage 21. The detection recess 38 is formed on an upper portion 12U of the apparatus body 12 on the slightly left side of an engaging recess 12*d* so that the projection 37 formed on the back surface of a scanner unit 13 is inserted into the detection recess 38 when the scanner unit 13 is closed. Further, vent holes 47 are formed on the upper portion 12U of the housing 12H at predetermined positions around the opening 12K. The plurality of ink supplying tubes 40 are held together and fixed at a position close to the adapters AD in a manner aligned with each other by a holding member 44 which is disposed on the front side of the carriage 21. The end of the plurality of ink supplying tubes 40 located downstream to the fixed position is connected to the supplying tubes (not shown) on the upper side of the adapters AD.

Figure 4:
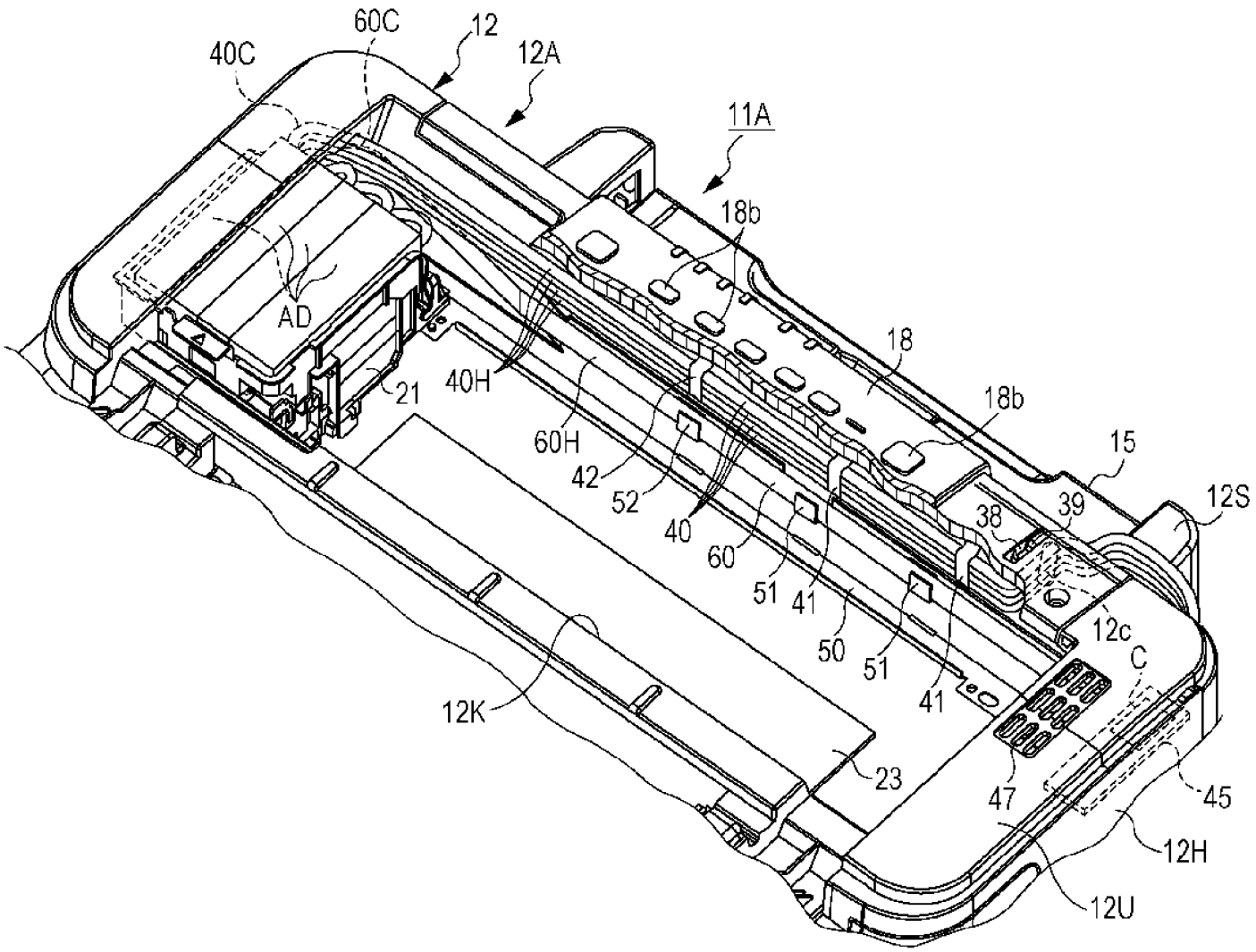
FIG. 4 is a perspective view of an essential part of the printer which shows routing of ink supplying tubes.

As shown in FIG. 4, the ink supplying tubes 40, one end of which is connected to each of the ink tanks 19T in the tank unit 19 which is disposed outside the apparatus body 12, are inserted into the housing 12H through the insertion hole 12*c* which is an example of insertion section formed on the front face of the housing 12H. The inserted ink supplying tubes 40 are routed to extend outside of the width direction of the operation panel unit 70 which is formed to protrude from the back surface of the operation panel 18, and extend along the flexible flat cable 60 (hereinafter, also referred to as "FFC 60") on the back surface of the operation panel unit 70.

As shown in FIG. 4, in this embodiment, ink supplying tubes 40 are wired in the gap between the FFC 60 and the housing 12H. That is, as seen from FIG. 4, the plurality of (for example, four) ink supplying tubes 40 are routed along the FFC 60 at the upper position in the height direction of the FFC 60. The end portion of the plurality of ink supplying tubes 40 which are routed on the outer side (outer circumference) of the FFC 60 is held and fixed by the holding members (not shown) which are disposed on the carriage 21. Then, the downstream end of the ink supplying tubes 40 is connected to each of the adapters AD on the carriage 21.

As shown in FIG. 4, the ink supplying tubes 40 inserted into the housing 12H are supported by a plurality of fixtures 41, 42 so as to extend in the main scan direction X. One of the plurality of fixtures 42 which is positioned most downstream in the ink supplying direction supports the ink supplying tubes 40 at a position slightly upstream to the center of the movement area of the carriage 21 in the main scan direction X. The portion of the ink supplying tubes 40 located downstream relative to the position fixed by the most downstream fixture 42 is a deformable portion 40H. The fixtures 41, 42 may be, for example, adhesive tapes or clips.

Further, a main substrate 45 is disposed in the apparatus body 12 of the printer 11A at a left end (the right end in FIG. 4). The main substrate 45 is provided with the controller C. The proximal end of the FFC 60 is directly connected to the controller C or is connected to the controller C via a relay substrate, which is not shown. A surface of the FFC 60 which extends from the controller C is positioned to be perpendicular to the transportation direction Y and is wired along the movement direction of the carriage 21. The FFC 60 is held by a plurality of hooks 51, 52 which are disposed on a front frame 50. The portion of the FFC 60 located downstream relative to the held position held by the most downstream hook 52 of a plurality of held positions is a deformable portion 60H.

Since the ink supplying tubes 40 are routed along the FFC 60 on the outer side of the FFC 60, the deformable portions 40H, 60H are routed along with each other. The distal end of the FFC 60 is connected to wiring terminals (not shown) on the carriage 21 and is electrically connected to the liquid ejection head 22. The controller C transmits ejection data and drive signals to the liquid ejection head 22 via the FFC 60 so as to control ink ejection of the liquid ejection head 22.

Figure 6:
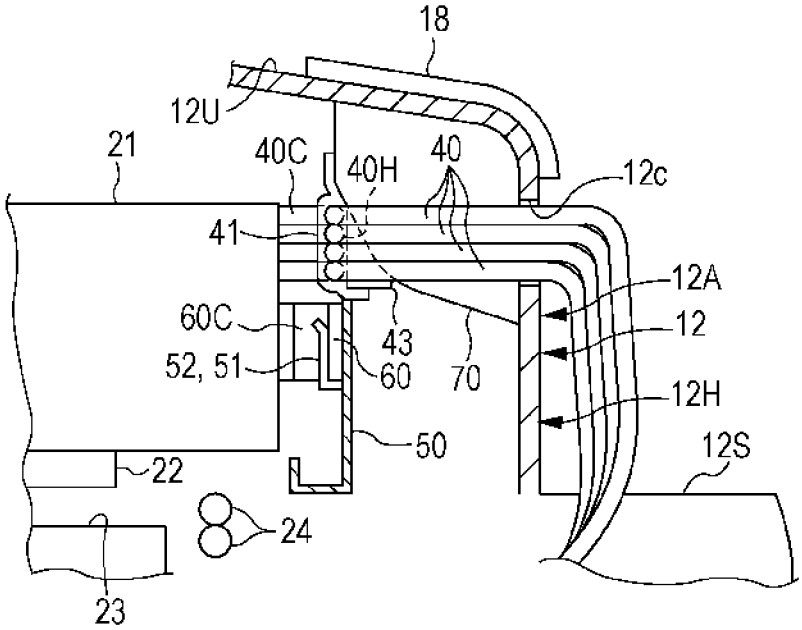
FIG. 6 is a schematic side sectional view which shows routing of the ink supplying tubes.

As shown in FIG. 6, the insertion hole 12*c* as an example of insertion section is formed on the front face of the housing 12H, while the ejection port 16 (see FIG. 1) is also disposed on the front face of the housing 12H. That is, the insertion hole 12*c* is formed on the front face of the housing 12H at a position that does not interfere with the container 12S which is a housing portion protruding from the front face of the housing 12H. Further, as shown in FIG. 6, the insertion hole 12*c* is formed on the front face of the housing 12H at a position that does not interfere with the operation panel unit 70 which protrudes from the back surface of the operation panel 18. The insertion hole 12*c* is disposed at a position slightly higher than the wiring height position of the flexible flat cable 60. The portion of ink supplying tubes 40 which extends on the back side of the operation panel unit 70 (the left side in FIG. 6) is fixed by the fixture 42 on the inclined surface of the back side of the operation panel unit 70 with a substantially triangular pole shaped member 43 interposed therebetween. Accordingly, the plurality of ink supplying tubes 40 are held with the surface of the ink supplying tubes 40 being perpendicular to the sub-scan direction Y.

Figure 5:
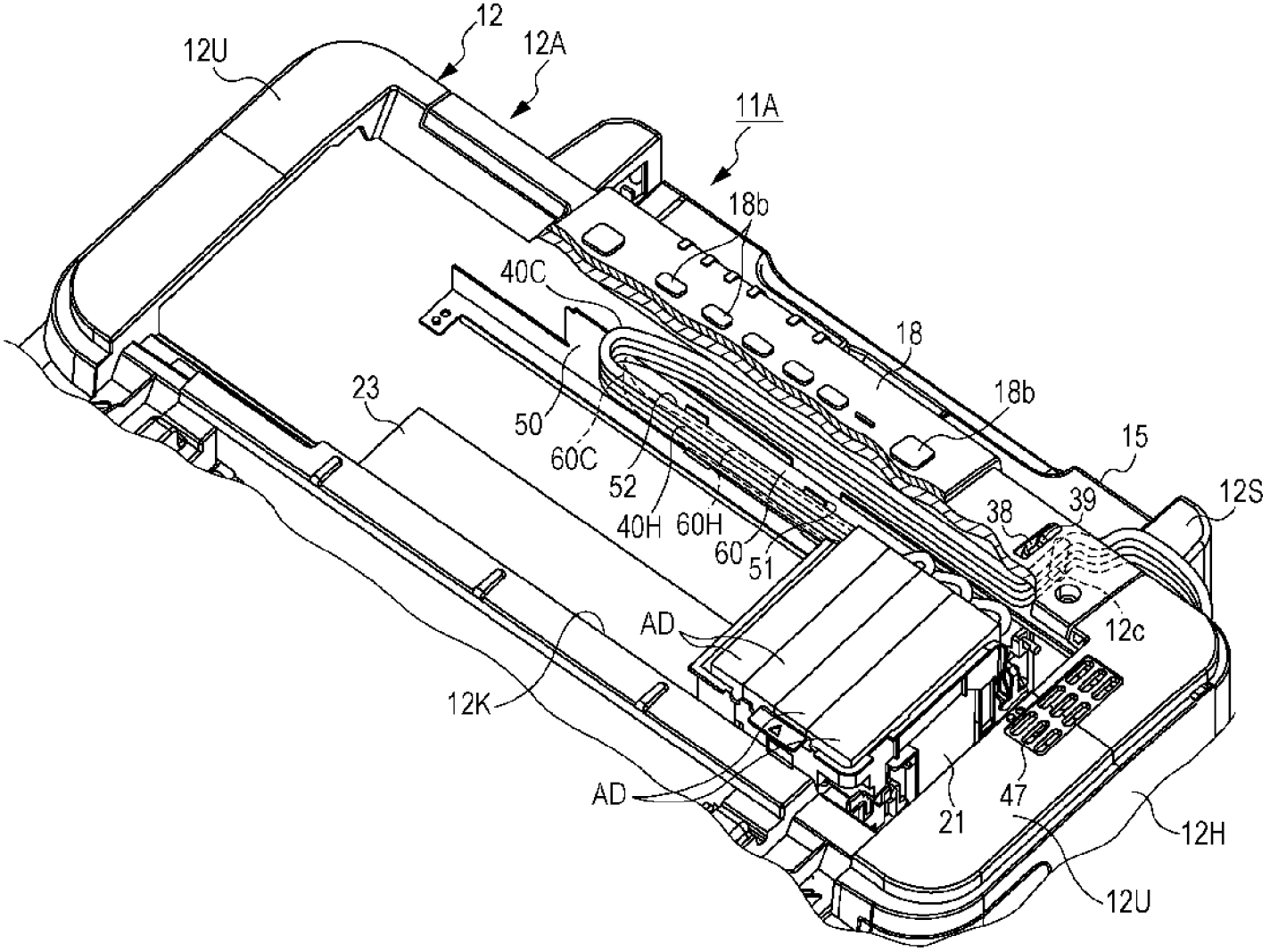
FIG. 5 is a perspective view of an essential part of the printer which shows routing of the ink supplying tubes.

The deformable portion 40H will be described briefly. FIG. 4 shows the ink supplying tubes 40 when the carriage 21 is at the home position, and FIG. 5 shows the ink supplying tubes 40 when the carriage 21 is at the opposite of the home position. The plurality of ink supplying tubes 40 are arranged almost in a line in the radial direction with the central axes are located on the same plane so that the ink supplying tubes 40 are arrayed in a plane. The plurality of ink supplying tubes 40 are curved in an arc at a curved section 40C. At the curved section 40C, the plurality of ink supplying tubes 40 (tube surfaces) are positioned substantially parallel to each other in the up-down direction.

When the carriage 21 moves, the curved section 40C of the ink supplying tubes 40 moves in the movement direction of the carriage 21 by approximately half of the movement amount (that is, at approximately half of the movement rate) of the carriage 21. While the carriage 21 moves from the home position to the position opposite of the home position, the ink supplying tubes 40 follow the movement of the carriage 21 with the curved section 40C being displaced to the right side in FIG. 4. As the ink supplying tubes 40 deform according to the movement of the carriage 21, the curved section 40C is displaced in the main scan direction X. Accordingly, the ink supplying tubes 40 can be prevented from being kinked or folded during movement of the carriage 21. Therefore, it is possible to smoothly supply ink to the adapters AD mounted on the carriage 21 via the ink supplying tubes 40 during movement of the carriage 21. Further, it is also possible to easily prevent a problem in printing caused by the kinked ink supplying tubes 40, for example, due to the ink supplying tubes 40 being in contact with the paper sheet P or a movement mechanism of the carriage 21 such as the transportation rollers 24 and the timing belt 27.

As shown in FIG. 4, the carriage 21 moves from a position closest to the curved section 40C (home position in FIG. 4) to a position farthest from the curved section 40C (the end position opposite of the home position). The portion of the ink supplying tubes 40 which contributes to formation of the curved section 40C during movement of the carriage 21 across the movement area is the deformable portion 40H. On the other hand, the portion of the ink supplying tubes 40 which is located upstream relative to the curved section 40C shown in FIG. 5 in the ink supplying direction is a non-deformable portion and does not contribute to formation of the curved section 40C. Although the ink supplying tubes 40 may be fixed by a fixing member at the interface between the deformable portion 40H and the non-deformable portion, the ink supplying tubes 40 of this embodiment is fixed at a position upstream from the interface by a predetermined distance to allow some looseness. The predetermined distance is preferably less than or equal to, for example, the larger of a distance of 30 percent of the tube length of the deformable portion 40H and 5 cm. It is because that, if the ink supplying tubes 40 are fixed at a position upstream from the interface by a distance much larger than the predetermined distance, the length of the free portion of the non-deformable portion that does not contribute to formation of the curved section 40C becomes larger, and the deformable portion 40H becomes too unstable to keep its shape. Accordingly, a problem due to kink of the tube portions which form the deformable portion 40H can be prevented as much as possible. The ink supplying tubes 40 may also be fixed at the interface as described above.

Next, the operation of the printer 11A according to the first embodiment will be described. In the printer 11A, the cover unit 75 can be closed to the position in which the sensor 39 senses the closed state, since the ink supplying tubes 40 are inserted into the housing 12H through the insertion hole 12*c*. Accordingly, when the user requests printing, the controller C starts the requested printing operation and the printer 11A can perform printing on the paper sheet P.

During printing operation, the deformable portions 40H, 60H of the FFC 60 and the ink supplying tubes 40 follow the movement of the carriage 21 with the curved sections 40C, 60C being displaced in the main scan direction X. Since the positions of the curved sections 40C, 60C are displaced in the main scan direction X while the ink supplying tubes 40 deform, the ink supplying tubes 40 can be prevented from being kinked or folded during deformation. Moreover, when maintenance is performed with the cover unit 75 open, a maintenance operation can be easily performed since the ink supplying tubes 40 do not extend through the opening surface of the opening 12K.

According to the first embodiment, the following effect can be achieved:

(1) Regardless of the liquid supplying tubes being routed between the outside and inside of the apparatus, the cover member can remain closed. Since the liquid supplying tubes are routed along the flexible flat cable which is also a flexible elongated member and is connected to the same carriage, securing of routing path (space) for the liquid supplying tubes is easy.

(2) The ink supplying tubes 40 which are inserted into the housing 12H are routed at the upper position of the flexible flat cable 60 in the housing 12H. Accordingly, even if the ink supplying tubes 40 and the flexible flat cable 60 follow the movement of the carriage 21 and deform, the ink supplying tubes 40 and the flexible flat cable 60 come into contact with each other less often than in the case where they are overlapped with each other.

(3) Since the insertion hole 12*c* is formed on the housing 12H at a position that does not interfere with the container 12S which is a protruding portion in which the sheet feeding cassette 15 is removably housed, the portion of the ink supplying tubes 40 from the ink tanks 19T to the insertion hole 12*c* can be routed without interfering with the container 12S which protrudes from the housing 12H. Accordingly, the ink supplying tubes 40 can be prevented from interfering with the attachment and removal of the sheet feeding cassette 15.

(4) The flexible flat cable 60 is wired in the housing 12H along the movement direction of the carriage 21 at a position opposite of the movement mechanism of the carriage 21 such as the guide frame 30, the timing belt 27 and the linear encoder 28 in the transportation direction of the target. Further, the insertion hole 12*c* is formed on the surface (that is, the front face) of the housing 12H on which the ejection port 16 of the paper sheet P is formed. Accordingly, since the ink supplying tubes 40 are routed along the flexible flat cable 60 at a position opposite of the movement mechanism of the carriage 21 in the transportation direction of the target, the routing space for the ink supplying tubes 40 can be easily secured without being disturbed by the movement mechanism and a risk that the ink supplying tubes 40 may interfere with the movement mechanism can be eliminated.

(5) Since the insertion hole 12*c* is formed at a position that does not interfere with the operation panel unit 70 which protrudes on the back surface (inner surface) of the housing 12H, routing of the ink supplying tubes 40 which is inserted into the housing 12H through the insertion hole 12*c* can be secured to the vicinity of the flexible flat cable 60, bypassing the operation panel unit 70. Accordingly, regardless of the configuration having the ink supplying tubes 40 inserted into the insertion hole 12*c*, a routing operation of the ink supplying tubes 40 is relatively easy.

(6) The printer 11A includes the cover unit 75 (cover member) which is rotatable so as to open and close the opening 12K of the housing 12H, the sensor 39 that senses the cover unit 75 is in the closed state, and the controller C that does not permit the printing operation (liquid ejection operation) under the state that the sensor 39 does not senses that the cover unit 75 is in the closed state. In this embodiment, since the ink supplying tubes 40 are not interposed between the apparatus body 12 and the cover unit 75 when the cover unit 75 is closed, the controller C permits the printing operation so that the printer 11A performs printing.

(7) The ink supplying tubes 40 include the deformable portion 40H that deforms with the movement of the carriage 21, and the deformable portion 40H is routed along the deformable portion 60H of the flexible flat cable 60. Accordingly, the deformable portion 40H of the ink supplying tubes 40 that deforms with the movement of the carriage 21 deforms with the deformable portion 60H of the flexible flat cable 60 in the same direction, thereby preventing the ink supplying tubes 40 and the flexible flat cable 60 from being interfered with each other during movement of the carriage 21.

(8) Since the ink supplying tubes 40 are routed along the FFC 60, the routing space of the ink supplying tubes 40 is relatively easily secured. Even if components for a plurality of mechanisms such as the printing section 20 are relatively closely arranged in the housing 12H, for example, to reduce the size of the printer, the routing space of the ink supplying tubes 40 can be easily secured.

(9) The ink supplying tubes 40 and the FFC 60 are routed such that the deformable portions 40H, 60H having the curved sections 40C, 60C are formed on the same side. Accordingly, when the deformable portion 40H of the ink supplying tubes 40 deforms with the movement of the carriage 21 with the curved section 40C being displaced in the main scan direction X, the deformable portion 60H of the FFC 60 also deforms in accordance with the deformation of the deformable portion 40H with the curved section 60C being displaced in the same direction. As a result, although the ink supplying tubes 40 are routed along and in the vicinity of another member, that is, the FFC 60, the ink supplying tubes 40 can be prevented from being interfered with another member.

Second Embodiment

Figure 7:
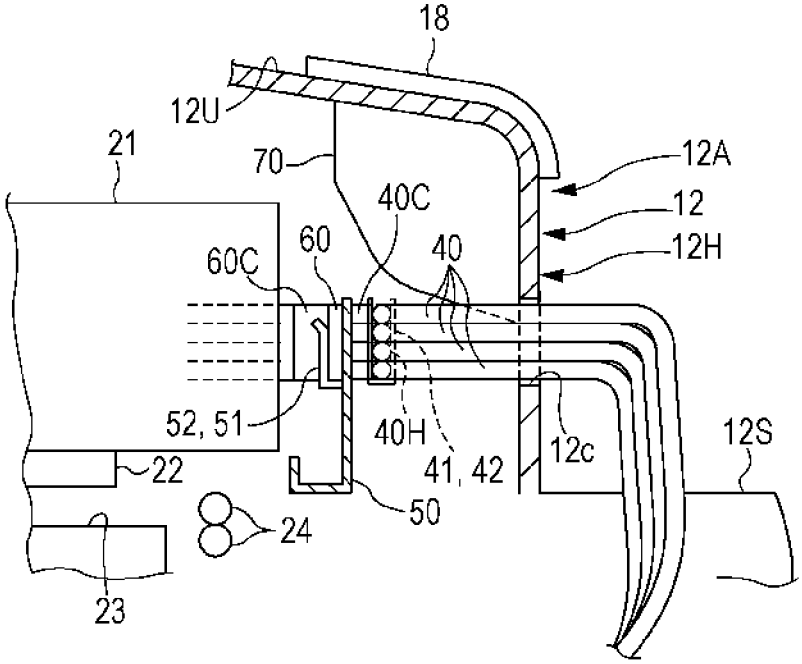
FIG. 7 is a schematic side sectional view which shows routing of the ink supplying tubes according to a second embodiment.
Figure 8:
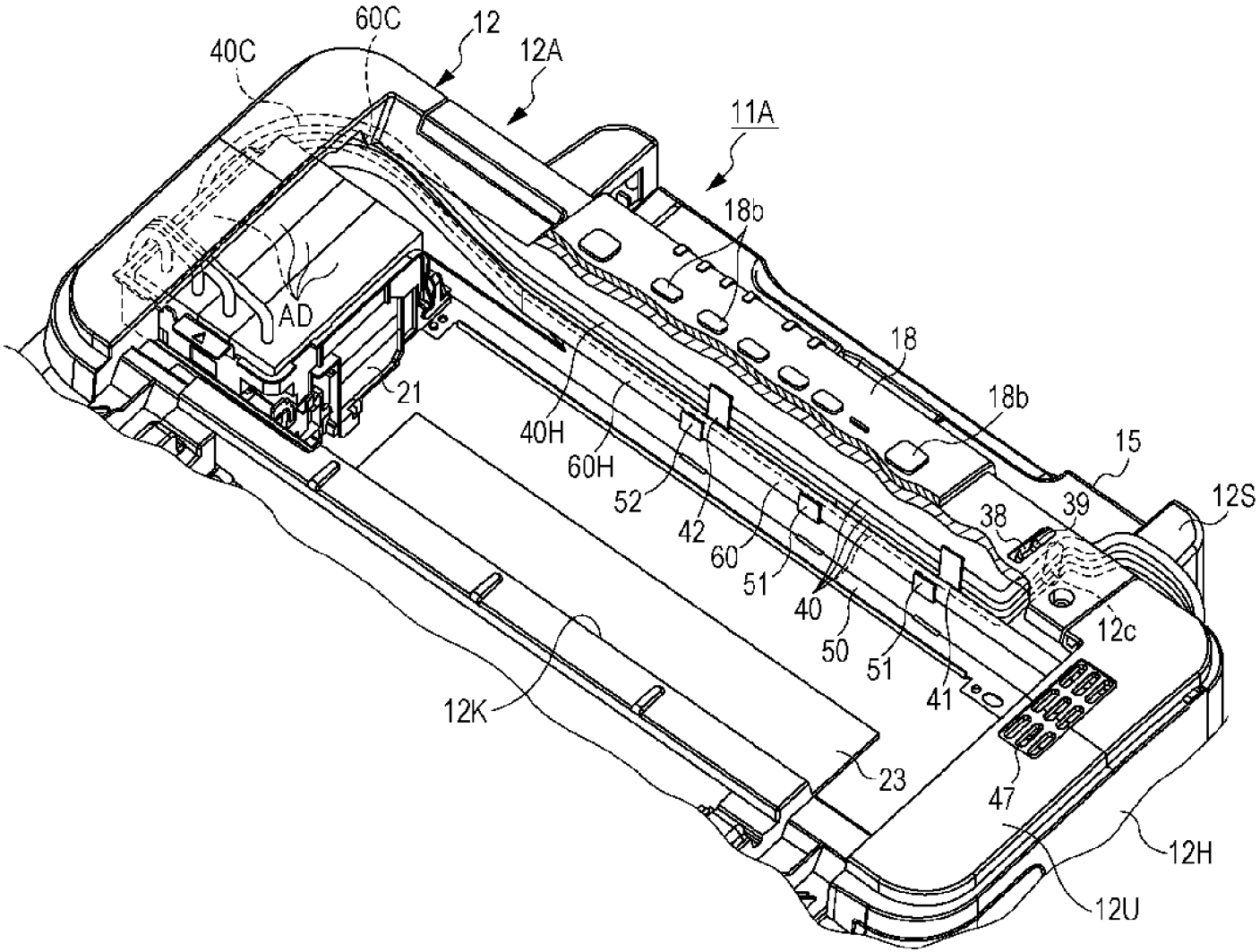
FIG. 8 is a perspective view of an essential part of the printer which shows routing of the ink supplying tubes.

With reference to FIGS. 7 and 8, a configuration of the second embodiment will be described. In the description of FIGS. 7 and 8, the same elements as those of FIGS. 1 to 6 are denoted by the same reference numerals and the description thereof will be omitted as appropriate.

As shown in FIG. 8, the ink supplying tubes 40, one end of which is connected to each of the ink tanks 19T in the tank unit 19 which is disposed outside the apparatus body 12, are inserted into the housing 12H through the insertion hole 12*c* formed on the front face of the housing 12H. The inserted ink supplying tubes 40 are routed to extend outside of the width direction of the operation panel unit 70 which is formed to protrude from the back surface of the operation panel 18, and extend along the flexible flat cable 60 on the back surface of the operation panel unit 70. As shown in FIG. 8, in this embodiment, ink supplying tubes 40 are wired in the gap between the FFC 60 and the housing 12H. That is, as seen from FIG. 8, the plurality of (for example, four) ink supplying tubes 40 are routed on the back surface (front side) of the FFC 60 as seen from the opening 12K along the longitudinal direction of the FFC 60, that is, the movement direction of the carriage 21. The end portion of the plurality of ink supplying tubes 40 which are routed on the outer side (outer circumference) of the FFC 60 is held and fixed by the holding members (not shown) which are disposed on the carriage 21. Then, the downstream end of the ink supplying tubes 40 is connected to each of the adapters AD.

As shown in FIG. 8, the ink supplying tubes 40 inserted into the housing 12H are supported by the plurality of fixtures 41, 42 so as to extend in the main scan direction X. One of the plurality of fixtures 42 which is positioned most downstream supports the ink supplying tubes 40 at a position slightly upstream to the center of the movement area of the carriage 21 in the main scan direction X. The portion of the ink supplying tubes 40 located downstream relative to the position fixed by the most downstream fixture 42 is a deformable portion 40H. The fixtures 41, 42 may be, for example, adhesive tapes or clips.

The proximal end of the FFC 60 is directly connected to the controller C or is connected to the controller C via the relay substrate, which is not shown. A surface of the FFC 60 which extends from the controller C is positioned to be perpendicular to the transportation direction Y and is wired along the movement direction of the carriage 21. The FFC 60 is held by a plurality of hooks 51, 52 which are disposed on the front frame 50. The portion of the FFC 60 located downstream relative to the held position held by the most downstream hook 52 of a plurality of held positions held by the hooks 51, 52 is a deformable portion 60H. Since the ink supplying tubes 40 are routed along the FFC 60 on the outer side of the FFC 60, the deformable portions 40H, 60H are routed along with each other. The distal end of the FFC 60 is connected to wiring terminals (not shown) on the carriage 21 and is electrically connected to the liquid ejection head 22.

As shown in FIG. 7, the insertion hole 12*c* as an example of insertion section similar to the first embodiment is formed on the front face of the housing 12H, while the ejection port 16 (see FIG. 1) is also disposed on the front face of the housing 12H. That is, the insertion hole 12*c* is formed on the front face of the housing 12H at a position that does not interfere with the container 12S which is a housing portion protruding from the front face of the housing 12H. Further, as shown in FIG. 7, the insertion hole 12*c* is formed at a position that does not interfere with the operation panel unit 70 in the main scan direction X while the operation panel unit 70 protrudes on the back surface of the operation panel 18 toward the inside of the housing 12H. The insertion hole 12*c* is disposed at a position higher than the wiring height position of the flexible flat cable 60. Since the plurality of ink supplying tubes 40 are held by the fixtures 41, 42 which are composed of a plurality of clips, the surface of the ink supplying tubes 40 are held to be perpendicular to the sub-scan direction Y. Although the fixtures 41, 42 are not shown in FIG. 7, the fixtures 41, 42 are fixedly provided on the front frame 50 via arms.

According to the second embodiment, the following effect can be achieved in addition to the effect (1) and (3) to (9) of the first embodiment:

(10) The ink supplying tubes 40 which are inserted into the housing 12H are routed in the gap between the flexible flat cable 60 and the housing 12H, the routing path of the ink supplying tubes 40 can be easily secured.

Third Embodiment

Figure 9:
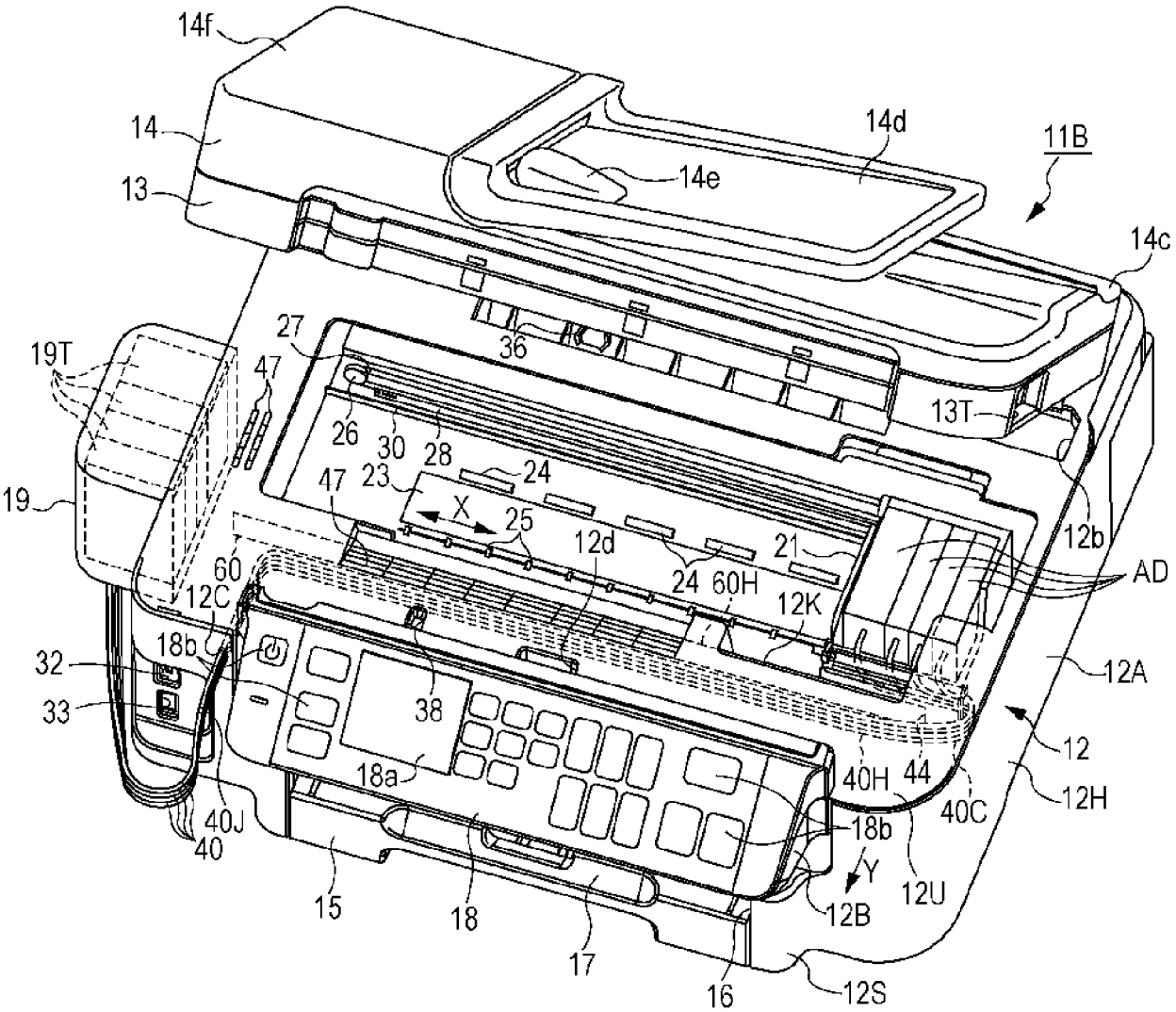
FIG. 9 is a perspective view of the printer according to a third embodiment.

As shown in FIG. 9, a printer 11B of the third embodiment is a so-called multifunction machine that includes a printer unit 12A (printer unit) formed by the apparatus body 12 having a printing function and the scanner unit 13 having a scanning function and disposed on the upper side of the apparatus body 12. As shown in FIG. 9, the printer 11B includes the apparatus body 12 formed in a substantially cuboid shape and the ink tanks 19T as an example of liquid container which are formed in a substantially cuboid shape and are provided separately from the apparatus body 12. Although not shown in FIG. 9, in the printer 11B, ink is supplied from the ink tanks 19T which are provided outside the apparatus body 12 and flows through the ink supplying tubes 40 which are inserted into a housing 12H through the insertion hole 12*c* to the liquid ejection head 22 via the adapters AD which are mounted on the carriage 21 in the apparatus body 12.

An overall configuration of the printer 11B will be described below. As shown in FIG. 9, the apparatus body 12 which receives the supplied ink includes the printer unit 12A which is provided with the printing section 20 and the scanner unit 13 which is provided with the scan mechanism such as a scanner that scans a manuscript (image). The printer unit 12A is disposed in the lower portion of the apparatus body 12, which is the side of the gravitational force direction, and the scanner unit 13 is disposed in the upper portion of the apparatus body 12, which is the side of the antigravitational force direction, as an example of cover member. The scanner unit 13 is rotatable (movable) about a hinge (not shown) disposed on the back side of the apparatus body 12 so as to move between open and closed positions. Recessed grips 35T are formed on the side faces (right and left sides) of the housing of the scanner unit 13, and during maintenance of the printer 11B, for example, the user can grip the grips 35T to lift the scanner unit 13. When the scanner unit 13 is lifted, the opening 12K which is disposed at an upper position of the printing section 20 is uncovered so that at least part of the movement area of the carriage 21 which is movable in a reciprocating manner in the printer unit 12A is exposed through the opening 12K.

Further, an auto document feeder 14 is disposed on the upper side of the scanner unit 13 so as to automatically feed the manuscript to be scanned to the scanner unit 13. The auto document feeder 14 is rotatable about a hinge on the back side so as to move between open and closed positions. When the auto document feeder 14 is lifted, a manuscript table (not shown) of the scanner unit 13 is exposed so that the user can manually supply the manuscript to be scanned to the scanner unit 13.

The auto document feeder 14 includes a main body 14*c*, a manuscript tray 14*d* which is disposed on the upper side of the main body 14*c* and is formed as a rectangular plate on which the manuscripts are set, and a guide member 14*e* which is used to position the manuscripts on the manuscript tray 14*d* in the width direction. The auto document feeder 14 further includes a feed mechanism unit 14*f* so that the manuscripts set on the manuscript tray 14*d* is fed out one by one to the manuscript table of the scanner unit 13 by driving the feed mechanism unit 14*f*. After scanning of the manuscript image, the manuscript is ejected on the main body 14*c*.

Further, the sheet feeding cassette 15 that is capable of storing a plurality of stacked paper sheets P is detachably mounted in the lower position of the apparatus body 12. The paper sheets P stored in the sheet feeding cassette 15 are fed out one by one in the forward direction to the printing section 20 which is provided in the printer unit 12A so that printing is performed on the fed out paper sheet P in the printing section 20. That is, the paper sheet P fed out from the sheet feeding cassette 15 is transported to the printing section 20 by a transportation mechanism such as rollers 24, 25 similar to those of the printer 11A. In the printing section 20, the liquid ejection head 22 reciprocates with the carriage 21 by the movement mechanism in the main scan direction X which is perpendicular to the transportation direction Y of the paper sheet P. When ink is ejected from the liquid ejection head 22 onto the paper sheet P, printing of images is performed. After printing is performed in the printing section 20, the paper sheet P is ejected from the ejection port 16 which is disposed on the front face of the apparatus body 12 (printer unit 12A).

The stacker 17 which is an example of ejection tray that receives the paper sheet P ejected from the ejection port 16 is housed in the apparatus body 12 (printer unit 12A) at a position above the sheet feeding cassette 15 and under the ejection port 16. A container 12S is formed by a housing portion which protrudes in the ejection direction of the paper sheet P (in this embodiment, a sub-scan direction Y). The sheet feeding cassette 15 and the ejection tray are housed in a housing recess which is disposed at the center of the container 12S in the width direction. The container 12S protrudes in the sub-scan direction Y, since a length of the sheet feeding cassette 15 in the sub-scan direction Y which is necessary for the printing section 20 is longer than a length of the housing 12H in the sub-scan direction. Accordingly, the sheet feeding cassette 15 and the stacker 17 are housed in the state that they protrude from the apparatus body 12 in the sub-scan direction Y (forward direction) with the front end faces of the sheet feeding cassette 15 and the stacker 17 being flush with the container 12S. More specifically, if the length of the apparatus body 12 in the sub-scan direction Y is determined based on the length of the sheet feeding cassette 15 in the sub-scan direction Y which is necessary for storing the paper sheets P of a predetermined size (for example, A4 size), it leads to increase in the size (footprint) of the apparatus body 12. In order to avoid this problem as much as possible, only the containing portion of the sheet feeding cassette 15 is formed to protrude from the apparatus body 12 and the portion on each side of the feeding cassette 15 is reduced in size. Further, since the front face of the stacker 17 in the housed state is positioned to be flush with the protruding front face of the sheet feeding cassette 15, a protruding length of the stacker 17 when pulled out becomes relatively large. As a result, the printer 11B is prevented from increasing in size (particularly, footprint) regardless of its configuration that the sheet feeding cassette 15 is detachably mounted on the front face of the apparatus body 12 and sheet feeding can be performed from the front side of the apparatus body 12.

As shown in FIG. 9, the operation panel 18 is disposed on the apparatus body 12 (printer unit 12A) at a position above the ejection port 16 so that the printing section 20 performs various operations such as a printing operation. The operation panel 18 has a base 12B which is formed by a housing portion having an inclined surface whose lower end extends farther in the ejection direction of the paper sheet P (that is, the sub-scan direction Y) than the upper end does. A display (for example, a liquid crystal display) 18*a* and the operation buttons 18*b* are disposed on the inclined surface of base 12B. The operation buttons 18*b* may include a power button, a selection button for selecting a desired item from a menu screen, a print start button for starting printing and a copy button. Since the operation panel 18 protrudes forward from the apparatus body 12 and the display and operation surface of the operation panel 18 is inclined downward, the user has a good visibility of the display 18*a* and a good operability of the operation buttons 18*b*.

The printing section 20 in the printer 11B of this embodiment includes the carriage 21 which is an example of moving member that reciprocates in the main scan direction X, and the liquid ejection head 22 that ejects ink is mounted on the carriage 21. The carriage 21 can move (reciprocate) in the main scan direction X when guided by a guide frame 30 which is a plate member that extends in the main scan direction X. The guide frame 30 includes the upper rail 31A and the lower rail 31B which are formed by bending the member in a substantially U-shape at the upper and lower ends on each side of the plate member which extends perpendicular to the main scan direction X. The carriage 21 reciprocates in the main scan direction X with the back end of the carriage 21 being supported by the upper rail 31A and the lower rail 31B. When ink is supplied from the ink supplying tubes 40 to the liquid ejection head 22 which is mounted on the reciprocating carriage 21, ink is ejected from the liquid ejection head 22, thereby performing printing on the paper sheet P.

In the printer 11B of this embodiment, the carriage 21 is in a substantially rectangular box shape having an open upper end. Adapters AD are mounted in the recessed mounting area at an upper position of the carriage 21 so as to allow ink which is supplied from the ink supplying tubes 40 to flow to the liquid ejection head 22. Accordingly, ink is supplied to the liquid ejection head 22 via the adapters AD mounted in the carriage 21. As a consequence, when the ink supplying tubes 40 are connected to the adapters AD so as to supply ink in the ink tanks 19T, the ink supplying tubes 40 form the ink flow paths so that ink flows from the ink tanks 19T to the liquid ejection head 22.

The printer 11B of this embodiment is available for color printing. In the example shown in FIG. 9, the adapters AD of the same number (for example, four) as that of ink colors necessary for color printing (for example, four colors) are provided. As a matter of course, the printer 11B can be used as a monochrome printer by mounting only the adapter AD for black color. Further, the carriage 21 can be used with the ink cartridges. Accordingly, the adapters AD have a rectangular plate shape which corresponds to the shape and size of the ink cartridges used for the printer 11B. Since the volume of ink for the adapters AD may be smaller than that of the ink cartridges, the shape and size of the adapters AD may be modified as appropriate as long as the adapters AD can be mounted in the mounting area of the carriage 21.

As shown in FIG. 9, a slot 32 for inserting a card such as a memory card and a communication card, and a communication port 33 (connector) that is compliant with a specific communication mode such as USB communication are formed on the left side of the front face of the apparatus body 12. The printer 11B can perform printing of the data received from a host device via USB communication or the image data such as photographs read out from a memory card. Further, a manual sheet feeding mechanism similar to that of the printer 11A is mounted on the back side of the apparatus body 12 (printer unit 12A).

As described above, the printer 11B which is a multifunction machine includes the apparatus body 12 and the ink tanks 19T as an example of liquid container which are formed in a substantially cuboid shape and are provided separately from the apparatus body 12. In the printer 11B, ink is supplied from the ink tanks 19T which are provided outside the apparatus body 12 and flows through the ink supplying tubes 40 which are inserted into the housing 12H through the insertion hole 12*c* to the liquid ejection head 22 via the adapters AD which are mounted on the carriage 21 in the apparatus body 12.

The plurality of ink supplying tubes 40 connected to the ink tanks 19T in the tank unit 19 are inserted into the housing 12H through the insertion hole 12*c* which is formed at a position that does not interfere with the container 12S which is a protruding portion of the housing 12H. Then, the ink supplying tubes 40 inserted into the housing 12H are routed along the FFC 60 which is wired in the main scan direction X in the housing 12H and are connected to the adapters AD on the carriage 21 as similar to those of the above embodiments.

Accordingly, the effect (1) to (10) of the above embodiments can also be achieved in the printer 11B according to the third embodiment.

Further, the above embodiments may be modified as follows:

- The insertion section may be disposed on the side face instead of the front face of the housing 12H.
- The insertion section may be a notch instead of an insertion hole.
- When the printer is configured to have the FFC which is wired along the guide frame 30, the ink supplying tubes may be routed along the guide frame 30 so that the ink supplying tubes are routed along the FFC. In such a printer, the insertion section may be formed either on a side face or back face (back side) of the housing.
- Although the ink supplying tubes are formed of a plurality of tubes and the joint 40J that connects the plurality of tubes, a single tube may be used without the joint 40J. Alternatively, a plurality of joints 40J may be used to connect the ink supplying tubes at a plurality of points instead of the joint 40J connecting the ink supplying tubes at a single point.
- A single ink supplying tube may also be used. For example, only the adapter AD for black ink is mounted on the carriage 21 and the ink tank 19T containing black ink is disposed outside the apparatus body 12. Then, a single ink supplying tube that connects the ink tank 19T and the adapter AD is routed through the insertion hole 12*c* as similar to the routing path of the above embodiments. With this configuration, the printer can be used as a monochrome printer.
- The plurality of ink supplying tubes 40 may be the separate ink supplying tubes arrayed in line in the radial direction, or may be an integrally formed multiple tube formed by connecting the plurality of tubes arrayed in line in the radial direction.
- In the printer 11B of the third embodiment, the cover member disposed on the upper side of the printer unit 12A may include the scanner unit 13 only without the auto document feeder 14.

Fourth Embodiment

Figure 10:
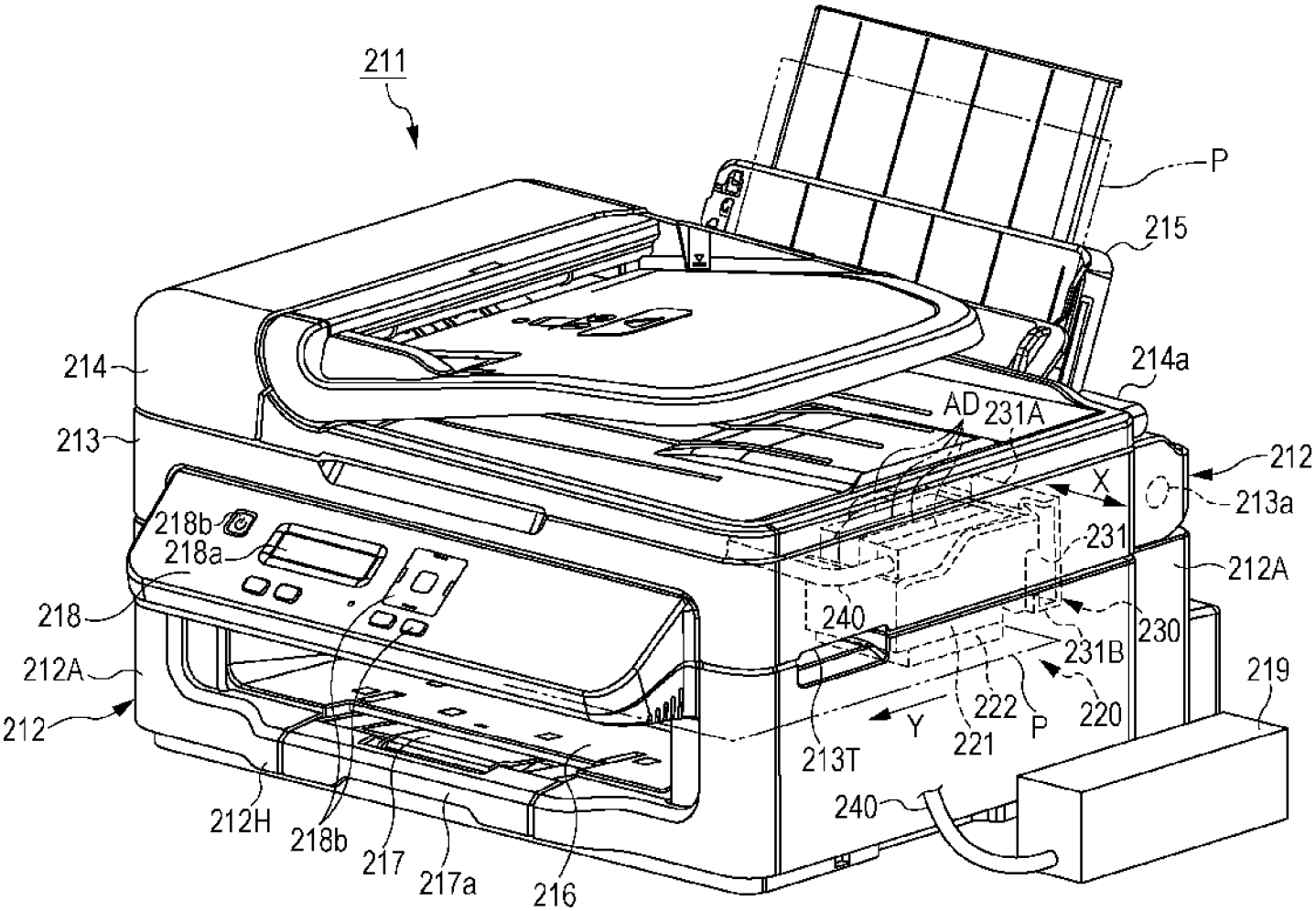
FIG. 10 is a perspective view of the printer according to a fourth embodiment.

With reference to FIG. 10, an overall configuration of a printer 211 according to the fourth embodiment will be described below. The printer 211 of the fourth embodiment includes an apparatus body 212 formed in a substantially cuboid shape and ink tank 219 as an example of liquid container which is formed in a substantially cuboid shape and is provided separately from the apparatus body 212.

The apparatus body 212 which receives the supplied ink includes a printer unit 212A which is provided with the printing section 220 and a scanner unit 213 which is provided with the scan mechanism such as a scanner that scans a manuscript (image). The printer unit 212A is disposed in the lower portion of the apparatus body 212, which is the side of the gravitational force direction, and the scanner unit 213 is disposed in the upper portion of the apparatus body 212, which is the side of the antigravitational force direction, as an example of cover member. The scanner unit 213 is rotatable (movable) about a rotation shaft 213*a* disposed on one end (back side) of the apparatus body 212 so that the side end (front side) of the scanner unit 213 which is located opposite of the rotation shaft 213*a* is lifted. That is, recessed grips 213T are formed on the side faces (right and left sides) of the housing of the scanner unit 213, and during maintenance of the printer 211, for example, the user can grip the grips 213T to lift the scanner unit 213. When the scanner unit 213 is lifted, an opening 212K (see FIG. 11A) which is disposed at an upper position of a printing section 220 is uncovered so that at least part of the movement area of a carriage 221 which is movable in a reciprocating manner in the printer unit 212A is exposed through the opening 212K.

Further, an auto document feeder 214 is disposed on the upper side of the scanner unit 213 so as to automatically feed the manuscript to be scanned to the scanner unit 213. The auto document feeder 214 is rotatable about a rotation shaft 214*a* disposed on one side (back side) of the apparatus body 212 so that the side end (front side) of the auto document feeder 214 which is located opposite of the rotation shaft 214*a* is lifted. When the auto document feeder 214 is lifted, the user can manually supply the manuscript to be scanned to the scanner unit 213.

A placement tray 215 that is capable of storing a plurality of stacked paper sheets P is mounted on the back side of the apparatus body 212. The paper sheets P stored in the placement tray 215 are fed out one by one in the forward direction to the printing section 220 which is provided in the printer unit 212A so that printing is performed on the fed out paper sheet P in the printing section 220. That is, the paper sheet P is transported from the placement tray 215 to the printing section 220 by a transportation mechanism, which is not shown, and then in the printing section 220, ink is ejected onto the paper sheet P from the liquid ejection head 222 that reciprocates in the main scan direction X which is perpendicular to the transportation direction (sub-scan direction Y)

by a movement mechanism, which is not shown, thereby performing printing of images. After images are printed on the paper sheet P in the printing section 220, the paper sheet P is transported further forward (sub-scan direction Y) from the printing section 220, and is ejected from the ejection port 216 which is formed on the front face of the apparatus body 212 (printer unit 212A).

A tray housing unit 212H which houses a stacker 217 as an example of ejection tray that receives the paper sheet P ejected from the ejection port 216 is disposed under the ejection port 216 of the apparatus body 212 (printer unit 212A). The tray housing unit 212H is formed by a housing portion that ejects in the ejection direction of the paper sheet P (in this embodiment, sub-scan direction Y). Due to this protruding shape, the stacker 217 can be easily pulled out from the apparatus body 212 by gripping a grip 217*a* and is pulled out from the apparatus body 212 in an ejection direction (transportation direction) of the paper sheet P by an amount corresponding to a length of the paper sheet P to be ejected.

Further, an operation panel 218 is disposed on the apparatus body 212 (printer unit 212A) at a position above the ejection port 216 so that the printing section 220 performs a printing operation. The operation panel 218 is formed by a housing portion having an inclined surface whose lower end extends farther in the ejection direction of the paper sheet P than the upper end does. Operation members that are operated during printing, for example, a display (for example, a liquid crystal display) 218*a* for displaying a menu screen and operation buttons 218*b* such as a power button are disposed on the inclined surface so that the user can easily operate the operation members.

The printing section 220 in the printer 211 of this embodiment includes the carriage 221 which is an example of moving member that reciprocates in the main scan direction X, and the liquid ejection head 222 that ejects ink is mounted on the carriage 221. The carriage 221 can move (reciprocate) in the main scan direction X when guided by a guide frame 230 which is a plate member that extends in the main scan direction X. That is, the guide frame 230 includes a rail section 231 having an upper rail 231A and a lower rail 231B which are formed by bending the member in a substantially U-shape at the upper and lower ends on each side of the plate member which extends perpendicular to the main scan direction X. The carriage 221 is guided by the upper rail 231A and the lower rail 231B to reciprocate on the rail unit 231 in the main scan direction X with the back end of the carriage 221 being supported by the upper rail 231A and the lower rail 231B in a so-called cantilever manner. When ink is supplied from an ink supplying tube 240 to the liquid ejection head 222 which is mounted on the reciprocating carriage 221, ink is ejected from the liquid ejection head 222, thereby performing printing on the paper sheet P.

In the printer 211 of this embodiment, an adapter AD is mounted on the carriage 221 so as to allow ink which is supplied from the ink supplying tube 240 to flow to the liquid ejection head 222. When the ink supplying tube 240 is connected to the adapter AD so as to supply ink in the ink tank 219, the ink supplying tube 240 forms the ink flow path so that ink flows from the ink tank 219 to the liquid ejection head 222.

In this embodiment, one type of ink (for example, black ink) may be supplied from the ink tank 219, and one relay adapter AD which corresponds to the one type of ink may be mounted on the carriage 221. When a plurality of types of ink are supplied the ink tanks 219, a plurality of relay adapters AD (up to four adapters AD in FIG. 10) which correspond to the plurality of types of ink may be mounted.

Next, with reference to FIGS. 11A and 11B, an insertion section that allows the ink supplying tube 240 to be inserted into the apparatus body 212 in the fourth embodiment will be described. In the fourth embodiment, a through hole 280 as an example of insertion section that allows the ink supplying tube 240 to be inserted in the longitudinal direction is provided on the printer unit 212A.

Figure 11A:
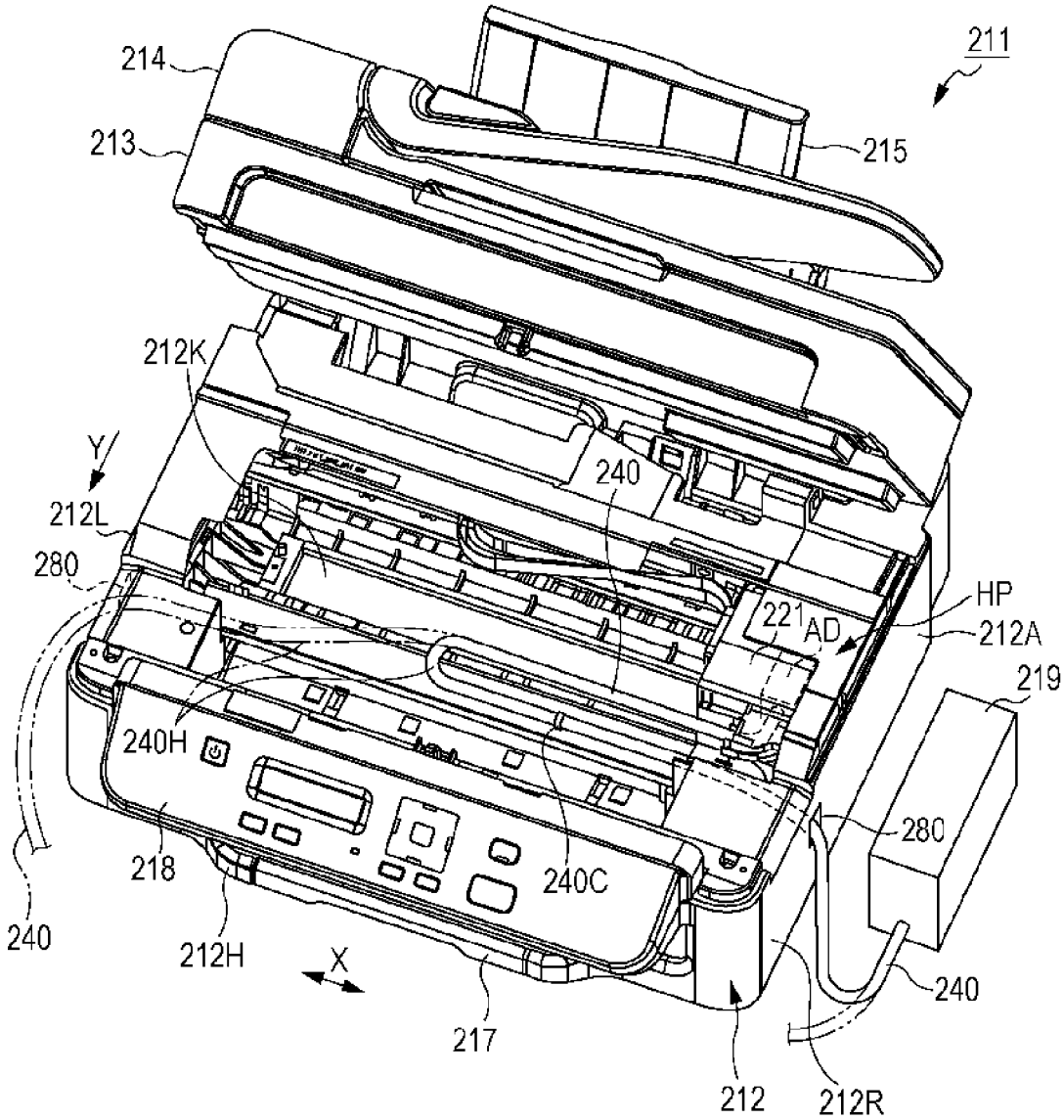
FIG. 11A is a perspective view of the printer having an insertion section according to the fourth embodiment showing that a scanner unit is lifted.

As shown in FIG. 11A, the ink tank 219 that contains ink which is ejected from the liquid ejection head 222 is disposed outside the housing on the right side of the apparatus body 212 as seen from the downstream side in the sub-scan direction Y. That is, the ink tank 219 is disposed outside the movement area of the carriage 221 and at a position close to a home position HP in the main scan direction X. One end of the ink supplying tube 240 which serves as the flow path of ink in the ink tank 219 is connected to the ink tank 219. The other end of the ink supplying tube 240 is inserted into the movement area of the carriage 221, which is exposed through the opening 212K formed on the printer unit 212A, from a position close to the home position HP in the main scan direction X of the carriage 221 and is connected to the relay adapter AD mounted on the carriage 221.

In this embodiment, one end of the ink supplying tube 240 is connected to the ink tank 219, while the other end is inserted into the apparatus body 212 from the outside through the through hole 280 which is formed on a right side face 212R of the apparatus body 212 (printer unit 212A) as seen from the downstream side in the sub-scan direction Y. That is, the through hole 280 is open on the side face on one end in the movement direction of the carriage 221 (main scan direction X), that is, on the right side face 212R of the housing member of the printer unit 212A such that the space area of the printer unit 212A communicates with the space area which is the movement area of the carriage 221 of the printer unit 212A.

The other end of the ink supplying tube 240 is inserted into the movement area of the carriage 221, which is exposed through the opening 212K, through the through hole 280. The ink supplying tube 240 has the longitudinal direction which is the direction along the movement direction of the carriage 221 and is connected to the relay adapter AD mounted on the carriage 221. The portion of the ink supplying tube 240 between the through hole 280 and the relay adapter AD in the longitudinal direction which is folded back in the main scan direction X (the portion which is curved in a substantially U-shape in FIG. 11A) is a deformable portion 240H that deforms with the movement of the carriage 221.

Figure 11B:
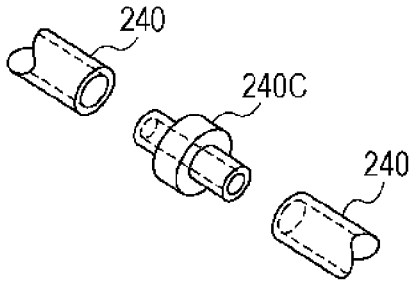
FIG. 11B is a perspective view which shows a joint for the ink supplying tube.

As shown in FIG. 11B, the ink supplying tube 240 of this embodiment may be formed by a plurality of tubes connected by a joint 240C in the longitudinal direction. A plurality of joints 240C are disposed at a plurality of points corresponding to the number of tubes to be connected between the ink tank 219 and the carriage 221 so that ink can flow through the connected tubes. In this embodiment, the joint 240C has a through hole and cylindrical portions into which the tube is inserted on each side so that two tubes are jointed with the joint 240C as shown in an example of FIG. 11B, and the tubes are jointed at one point in the deformable portion 240H of the ink supplying tube 240 as shown in FIG. 11A.

Further, in this embodiment, the through hole 280 may be configured to be formed on a left side face 212L of the apparatus body 212 (printer unit 212A) at a position opposite of the home position HP in the main scan direction X of the carriage 221 in the apparatus body 212 (printer unit 212A) as indicated by the two dotted line in FIG. 11A.

Also in this configuration, the other end of the ink supplying tube 240 is inserted into the movement area of the carriage 221, which is exposed through the opening 212K, through the through hole 280. The ink supplying tube 240 has the longitudinal direction which is the direction along the movement direction of the carriage 221 and is connected to the relay adapter AD mounted on the carriage 221. The portion of the ink supplying tube 240 between the through hole 280 and the relay adapter AD in the longitudinal direction which extends in a wide curve, for example, as indicated by the two dotted line in FIG. 11A, is a deformable portion 240H that deforms with the movement of the carriage 221. In the configuration in which the through hole 280 is formed on the left side face 212L, in order to decrease the length of the ink supplying tube 240, the ink tank 219 is preferably disposed outside the housing on the left side of the apparatus body 212 as seen from the downstream side in the sub-scan direction Y, that is, at a position opposite of the home position HP in the main scan direction X of the carriage 221.

Next, the operation of the printer 211 according to the fourth embodiment will be described. The ink supplying tube 240 allows for ink flow from the ink tank 219 to the liquid ejection head 222 through the through hole 280 regardless of whether the scanner unit 213 is placed to open or close the opening 212K. The through hole 280 is not limited to a rectangular shape as shown in FIG. 11A, and may be in any shape such as circular and oval as long as the ink supplying tube 240 can be inserted without being collapsed. Further, a tapered shape (not shown) having a decreasing opening area, for example, from the opening surface of the right side face 212R to the inside may be formed.

When the ink supplying tube 240 is inserted through the through hole 280 formed on the right side face 212R, which is one end of the movement direction of the carriage 221, the ink supplying tube 240 can be inserted along the movement direction of the carriage 221 with a high probability. Accordingly, the longitudinal direction of the ink supplying tube 240 inserted through the through hole 280 can be a direction along the movement direction of the carriage 221.

According to the fourth embodiment, the following effect can be achieved:

(1) Even if the scanner unit 213 is placed to close the opening 212K of the apparatus body 212 (printer unit 212A), the ink supplying tube 240 can be inserted into the opening 212K of the printer unit 212A so that ink is supplied to the carriage 221 which is disposed inside the printer unit 212A. Accordingly, the scanner unit 213 can be remained to close the opening 212K of the printer unit 212A while ink is supplied, for example, from the ink tank 219 which is provided outside the apparatus body 212 to the liquid ejection head 222 which is provided inside the apparatus body 212.

(2) The longitudinal direction of the ink supplying tube 240 inserted through the through hole 280 can be a direction along the movement direction of the carriage 221. Accordingly, the length of the tube necessary for supplying ink to the moving carriage 221 (for example, the length of the ink supplying tube 240 necessary for forming the deformable portion 240H that deforms with the movement of the carriage 221) can be easily inserted into the opening 212K.

Fifth Embodiment

Figure 12:
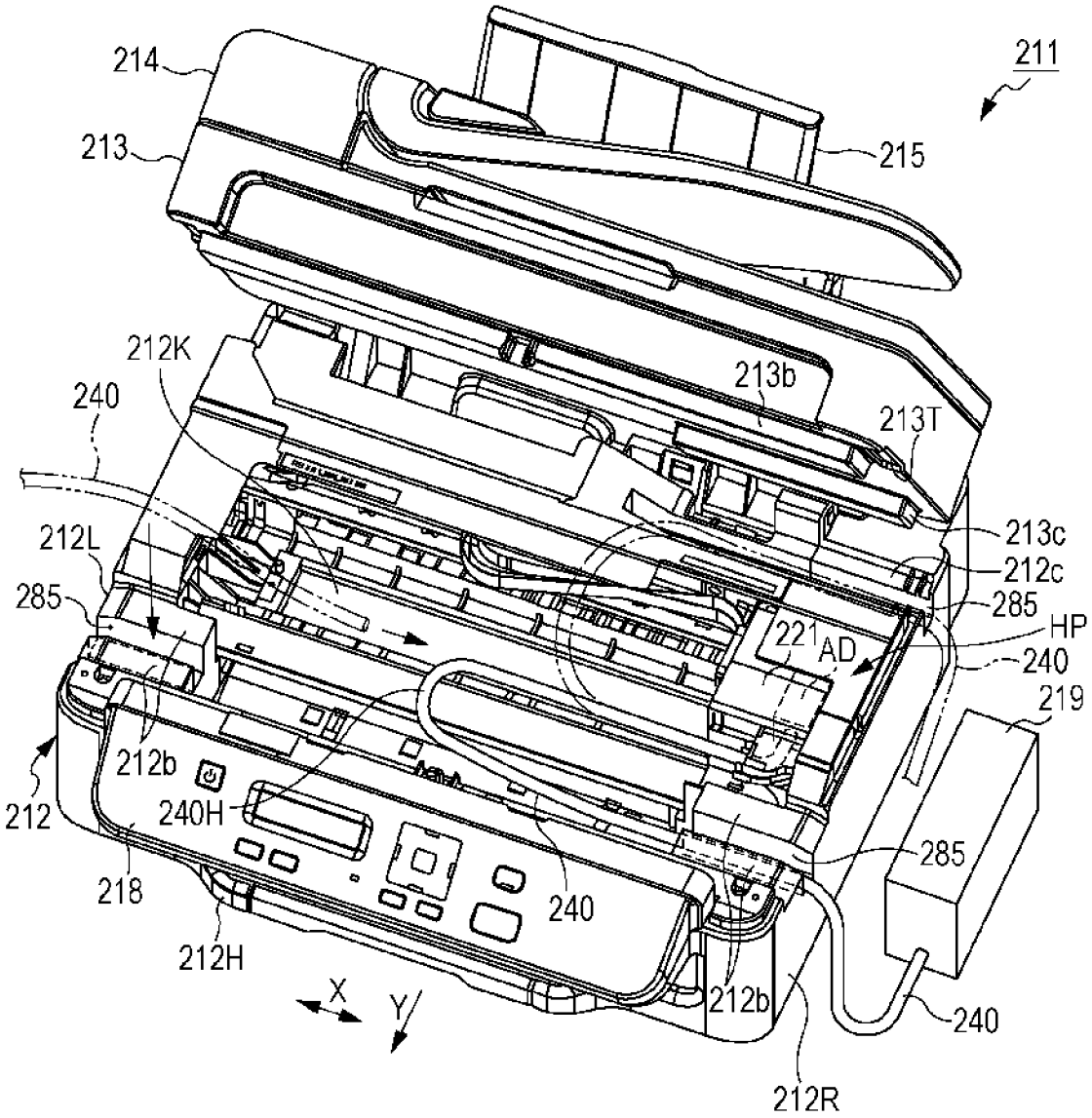
FIG. 12 is a perspective view of the printer in which the insertion section according to a fifth embodiment is provided in the printer unit showing that the scanner unit is lifted.
Figure 13:
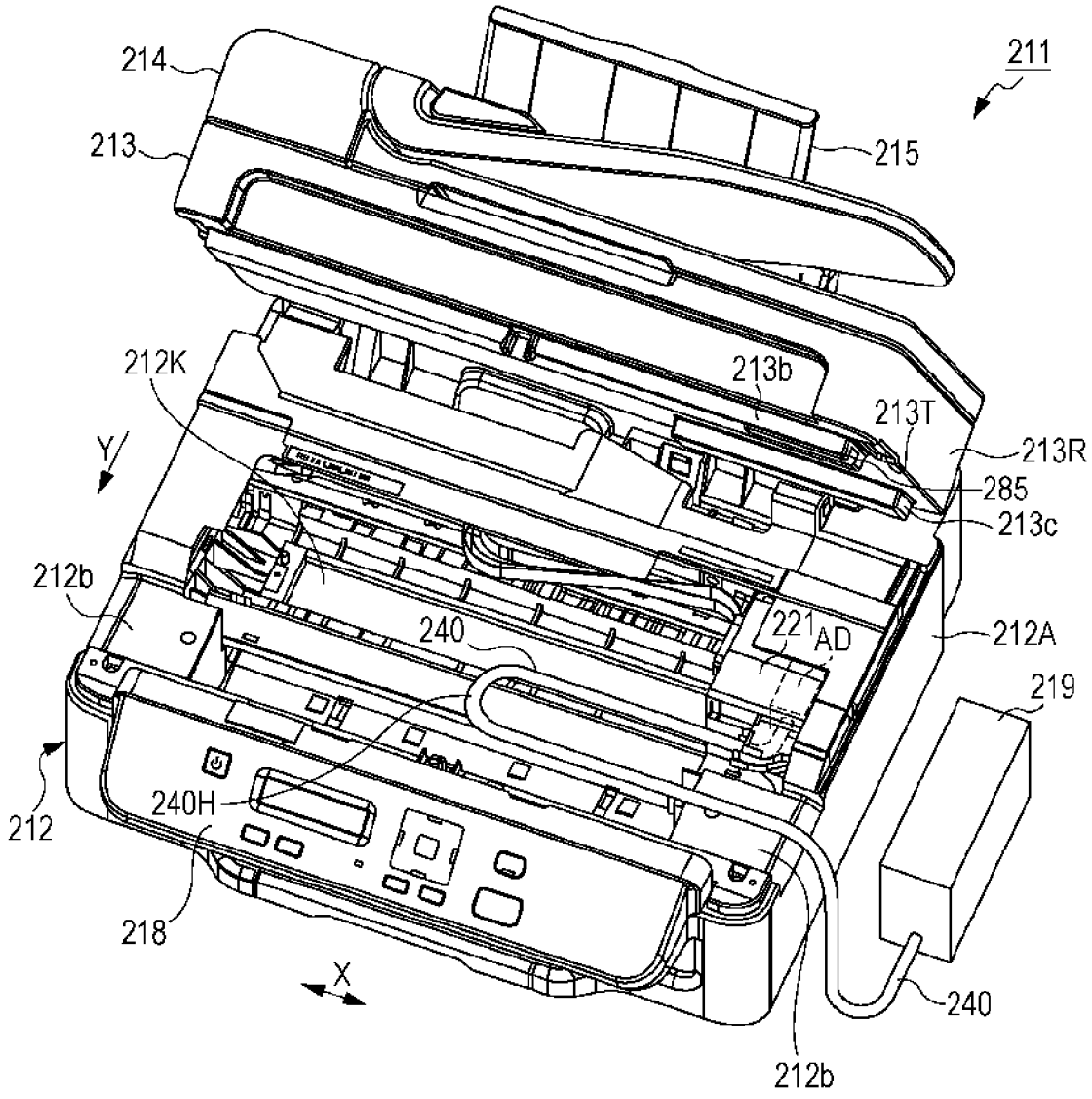
FIG. 13 is a perspective view of the printer in which the insertion section according to the fifth embodiment which is provided in the scanner unit showing that the scanner unit is lifted.

With reference to FIGS. 12 and 13, an insertion section that allows the ink supplying tube 240 to be inserted into the apparatus body 212 in the fifth embodiment will be described. In the fifth embodiment, a recessed groove 285 as an example of insertion section is provided on the printer unit 212A or the scanner unit 213 so as to allow the ink supplying tube 240 to be inserted in the longitudinal direction. In the description of this embodiment, the same elements as those of the fourth embodiment are denoted by the same reference numerals and the description thereof will be omitted as appropriate. Further, the joint 240C of the ink supplying tube 240 is not shown in FIGS. 12 and 13.

As shown in FIG. 12, the ink tank 219 that contains ink which is ejected from the liquid ejection head 222 is disposed outside the housing on the right side of the apparatus body 212 as seen from the downstream side in the sub-scan direction Y. One end of the ink supplying tube 240 which serves as the flow path of ink in the ink tank 219 is connected to the ink tank 219. The other end of the ink supplying tube 240 is inserted into the movement area of the carriage 221, which is exposed through the opening 212K formed on the printer unit 212A, from a position close to the home position HP in the main scan direction X of the carriage 221 and is connected to the relay adapter AD mounted on the carriage 221.

As shown in FIG. 12, in the printer 211, the scanner unit 213 is disposed on the upper side of the printer unit 212A and is rotatably supported on the back side of the printer unit 212A. Recessed portions 212*b* as an example of recess are disposed on the front side of the opening 212K at positions that oppose a projecting portion 213*b* which is an example of projection that is formed on the scanner unit 213 and protrudes toward the printer unit 212A. Further, a recessed portion 212*c* as an example of recess is disposed on the back side of the opening 212K at a position that opposes a projecting portion 213*c* which is an example of projection that is formed on the scanner unit 213 and protrudes toward the printer unit 212A. The recessed portions 212*b* are disposed on each side of the opening 212K in the main scan direction X.

As the insertion section of this embodiment, the recessed groove 285 is formed at least at one of the recessed portions 212*b*, 212*c* to communicate with the opening 212K. In this embodiment, the recessed groove 285 is a groove having a substantially U-shaped or rectangular section and a width and a depth which is substantially the same size as the outer diameter of the ink supplying tube 240, and is formed by notching the housing in the main scan direction X. FIG. 12 shows that the recessed grooves 285 are formed at all the recessed portions 212*b*, 212*c*, and the ink supplying tube 240 is inserted into the recessed groove 285 at the recessed portion 212*b* that is formed on the right and front of the opening 212K.

The other end of the ink supplying tube 240 is inserted through the recessed groove 285 into the movement area of the carriage 221 with the longitudinal direction extending in the direction along the movement direction of the carriage 221 and is connected to the relay adapters AD mounted on the carriage 221. The portion of the ink supplying tube 240 between the recessed groove 285 and the relay adapter AD in the longitudinal direction which is folded back in the main scan direction X (the portion which is curved in a substantially U-shape in FIG. 12) is a deformable portion 240H that deforms with the movement of the carriage 221.

Further, as indicated by the two dotted line in FIG. 12, the ink supplying tube 240 may be inserted into the recessed groove 285 at the recessed portion 212*c*. Alternatively, when the ink supplying tube 240 is inserted into the recessed groove 285, for example, at the recessed portion 212*b* on the left side, the ink supplying tube 240 can be inserted into the recessed groove 285 from the above, as indicated by the two dotted line in FIG. 12, so that ink supplying tube 240 is inserted into the opening 212K by a predetermined tube length from the other end of the ink supplying tube 240.

Next, the operation of the printer 211 according to the fifth embodiment will be described. Even if the scanner unit 213 is placed to close the opening 212K of the apparatus body 212, the ink supplying tube 240 can extend between the inside and outside of the apparatus body 212 through the recessed groove 285 formed at the recessed portion 212*b*. Accordingly, while one end of the ink supplying tube 240 is connected to the ink tank 219 which is disposed outside the apparatus body 212, the other end can be inserted into the space area of the opening 212K through the recessed groove 285. As a result, in this embodiment, the recessed groove 285 serves as the insertion section through which the ink supplying tube 240 is inserted so as to extend between the printer unit 212A and the scanner unit 213 when the scanner unit 213 is placed to close the opening 212K of the printer unit 212A.

According to the fifth embodiment, the following effect can be achieved in addition to the effect (1) of the fourth embodiment:

(3) When the ink supplying tube 240 is inserted into the recessed groove 285, the recessed portion 212*b* allows the ink supplying tube 240 to be easily guided into the recessed groove 285.

(4) When the scanner unit 213 is placed to close the opening 212K of the printer unit 212A, the ink supplying tube 240 can be stably positioned in the recessed groove 285 by inserting the ink supplying tube 240 between the projecting portion 213*b* and the recessed portion 212*b*.

(5) Since the longitudinal direction of the ink supplying tube 240 inserted through the recessed groove 285 can be the direction along the movement direction of the carriage 221, the length of the tube that deforms with the movement of the carriage 221 necessary for supplying ink to the moving carriage 221 can be easily inserted into the printer unit 212A.

(6) A configuration can be easily achieved in which the ink supplying tube can be inserted into the space area of the opening 212K of the printer unit 212A through the recessed groove 285 formed by notching, even if the scanner unit 213 is placed to close the opening 212K of the printer unit 212A.

Further, the above embodiments may be modified as follows:

The through hole 280 as the insertion section of the fourth embodiment may be formed on the scanner unit 213. Although not shown in the figure, the scanner unit 213 includes a through hole formed by one opening which is disposed on the underside that opposes the opening 212K and comminicates with the other opening which is disposed on the surface other than the underside. The end portion of the ink supplying tube 240 is inserted through the other opening and is pulled out through the one opening, and is then inserted into the opening 212K.

The recessed groove 285 as the insertion section of the fifth embodiment may be formed on the scanner unit 213 instead of the printer unit 212A. The following description is provided with reference to FIG. 13.

As shown in FIG. 13, the recessed groove 285 as the insertion section is disposed on the projecting portion 213*b* which is an example of projection that is formed on the scanner unit 213 and protrudes toward the printer unit 212A at a position that opposes the recessed portion 212*b*. That is, the recessed groove 285 is formed by notching the housing in the main scan direction X from the right side face 213R of the scanner unit 213 by a predetermined length such that the space area of the opening 212K communicates with the space area outside of the apparatus body 212 when the scanner unit 213 is turned to close the opening 212K of the printer unit 212A. With this configuration, the ink supplying tube 240 can be inserted into the recessed groove 285.

Accordingly, before the scanner unit 213 is turned to close the opening 212K, the ink supplying tube 240 is positioned at a position that substantially opposes the recessed groove 285 on the upper surface of the recessed portion 212*b* of the printer unit 212A. With this configuration, when the scanner unit 213 is turned to close the opening 212K, ink supplying tube 240 is smoothly inserted into the recessed groove 285 on the scanner unit 213.

The recessed groove 285 is preferably formed as a groove having a width and a depth which is substantially the same size as the outer diameter of the ink supplying tube 240 or slightly smaller than the outer diameter of the ink supplying tube 240. With this configuration, since the ink supplying tube 240 is inserted and fit into the recessed groove 285, the ink supplying tube 240 is restricted to move in the longitudinal direction. Accordingly, the portion of the ink supplying tube 240 between the recessed groove 285 and the relay adapter AD in the longitudinal direction which is folded back in the main scan direction X (the portion which is curved in a substantially U-shape in FIG. 13) is a deformable portion 240H that deforms with the movement of the carriage 221.

In the fifth embodiment, the recessed groove 285 as the insertion section may be formed on both the printer unit 212A and the scanner unit 213. An example of such an insertion section will be described with reference to FIG. 14.

Figure 14:
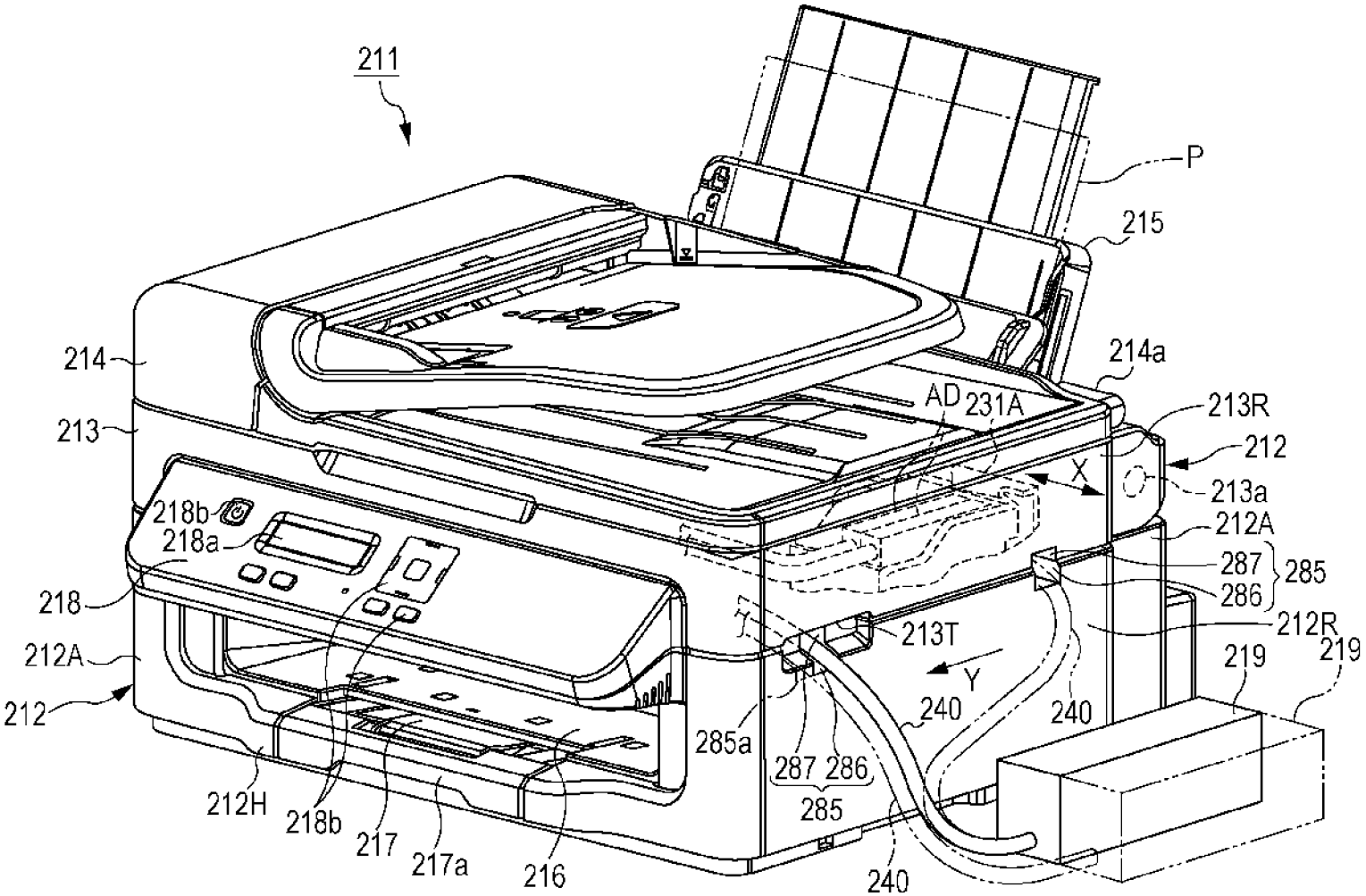
FIG. 14 is a perspective view of the printer in which the insertion section according to the fifth embodiment which is provided in both the printer unit and the scanner unit.

As shown in FIG. 14, a first recessed groove 286 and a second recessed groove 287 at the grip 213T are formed as an example of recess on the recessed portion 212*b* of the printer unit 212A and on the projecting portion 213*b* of the scanner unit 213, respectively, so that the recesses of the first recessed groove 286 and the second recessed groove 287 oppose with each other. That is, the recessed groove 285 as the insertion section is formed by the first recessed groove 286 and the second recessed groove 287 which are formed by notching the housing in the main scan direction X from the right side face 212R so that the space area of the opening 212K communicates with the space area outside of the apparatus body 212. With this configuration, when the scanner unit 213 is turned to close the opening 212K of the printer unit 212A, the ink supplying tube 240 can be inserted into the recessed groove 285 which is formed by stacking the scanner unit 213 on the printer unit 212A.

With this configuration, since the recess on the scanner unit 213 and the printer unit 212A can be formed with a small depth, the recessed groove 285 of the ink supplying tube 240 can be formed on the upstream side (back side) of the sub-scan direction Y, for example, as shown in FIG. 14. That is, the recessed groove 285 can be formed in a wide area on the surface of the housing.

In the fifth embodiment, the recessed groove 285 may not be necessarily formed on the recessed portions 212*b*, 212*c*. The recessed groove 285 may be formed at any position on the housing of the apparatus body 212 as long as not bothering the operation of the printer 211.

Although the ink supplying tube 240 has been described as one tube in the fourth and fifth embodiments, when a plurality of ink tanks 219 are provided in the printer 211, a configuration can be possible in which ink is supplied from each of the ink tanks 219 via the respective ink supplying tubes 240 to the liquid ejection head 222. An example of providing a plurality of ink supplying tubes 240 will be described with reference to FIG. 14.

As indicated by the two dotted line in FIG. 14, the plurality of (in this example, two) ink supplying tubes 240 are inserted into the recessed grooves 285 which have a width that allows two tubes to be inserted. The ink supplying tubes 240 are inserted into the recessed grooves 285 while being placed in parallel with each other in the horizontal direction along the surface of the recessed portion 212*b* and are connected to two relay adapters AD mounted on the carriage 221.

The two ink supplying tubes 240 may be formed by the tubes connected in parallel with each other or the separate tubes. When the ink tanks 219 are disposed at separate positions (for example, on the right and left sides of the apparatus body 212), two ink supplying tubes 240 may be inserted through the recessed grooves 285 that are disposed at separate positions (on the right side face 212R and the left side face 212L).

With this configuration, ink can be supplied from each of the ink tanks 219 to the liquid ejection head 222 via the number of ink supplying tubes 240 which corresponds to the number of the ink tanks 219.

The through hole 280 of the fourth embodiment may not be necessarily formed on the surface of the apparatus body 212 which extends in the direction perpendicular to the main scan direction X. For example, the through hole 280 may be formed on the surface which extends in the direction along the main scan direction X such as the front face and the back face (back surface) of the apparatus body 212 as long as the ink supplying tube 240 can extend in the direction along the main scan direction X after being inserted into the space area of the opening 212K through the through hole 280.

In the fifth embodiment, the recessed groove 285 may not be necessarily formed by notching in the direction along the main scan direction X. For example, the recessed groove 285 may be formed by notching in the direction along the sub-scan direction Y as long as the ink supplying tube 240 can extend in the direction along the main scan direction X after being inserted into the space area of the opening 212K through the recessed groove 285.

Sixth Embodiment

An overall configuration of the printer 211 according to the sixth embodiment is the same as that of the fourth embodiment described with reference to FIG. 10.

Figure 15A:
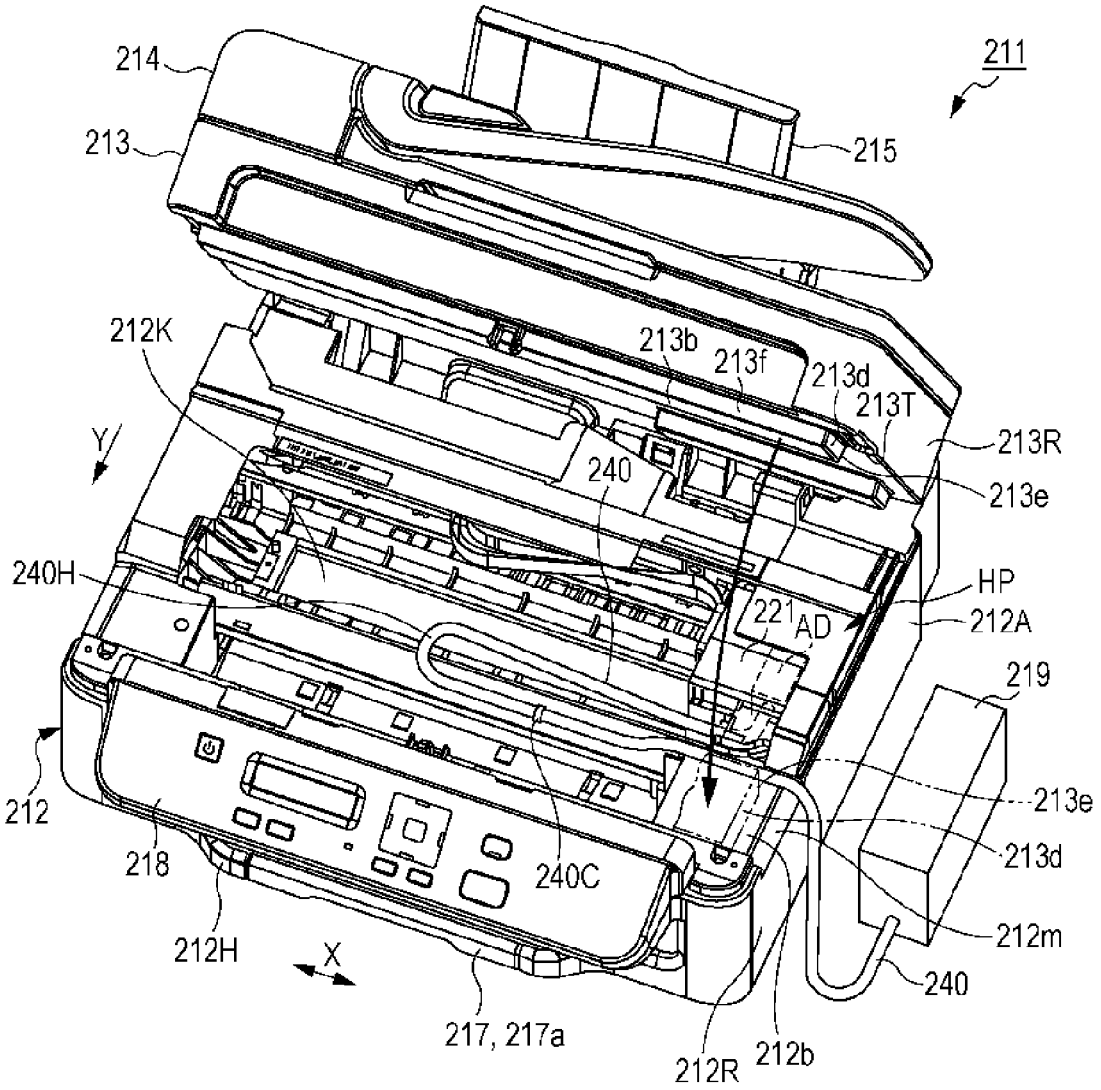
FIG. 15A is a perspective view of the printer in which the ink supplying tube is disposed according to a sixth embodiment showing that the scanner unit is lifted.
Figure 15B:
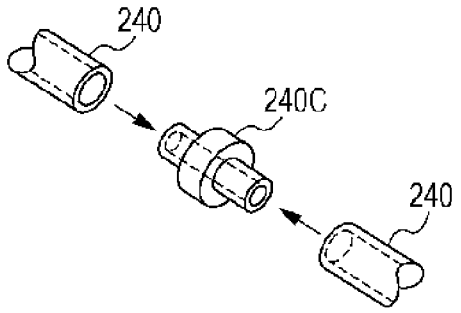
FIG. 15B is a perspective view which shows the joint for the ink supplying tube.
Figure 16:
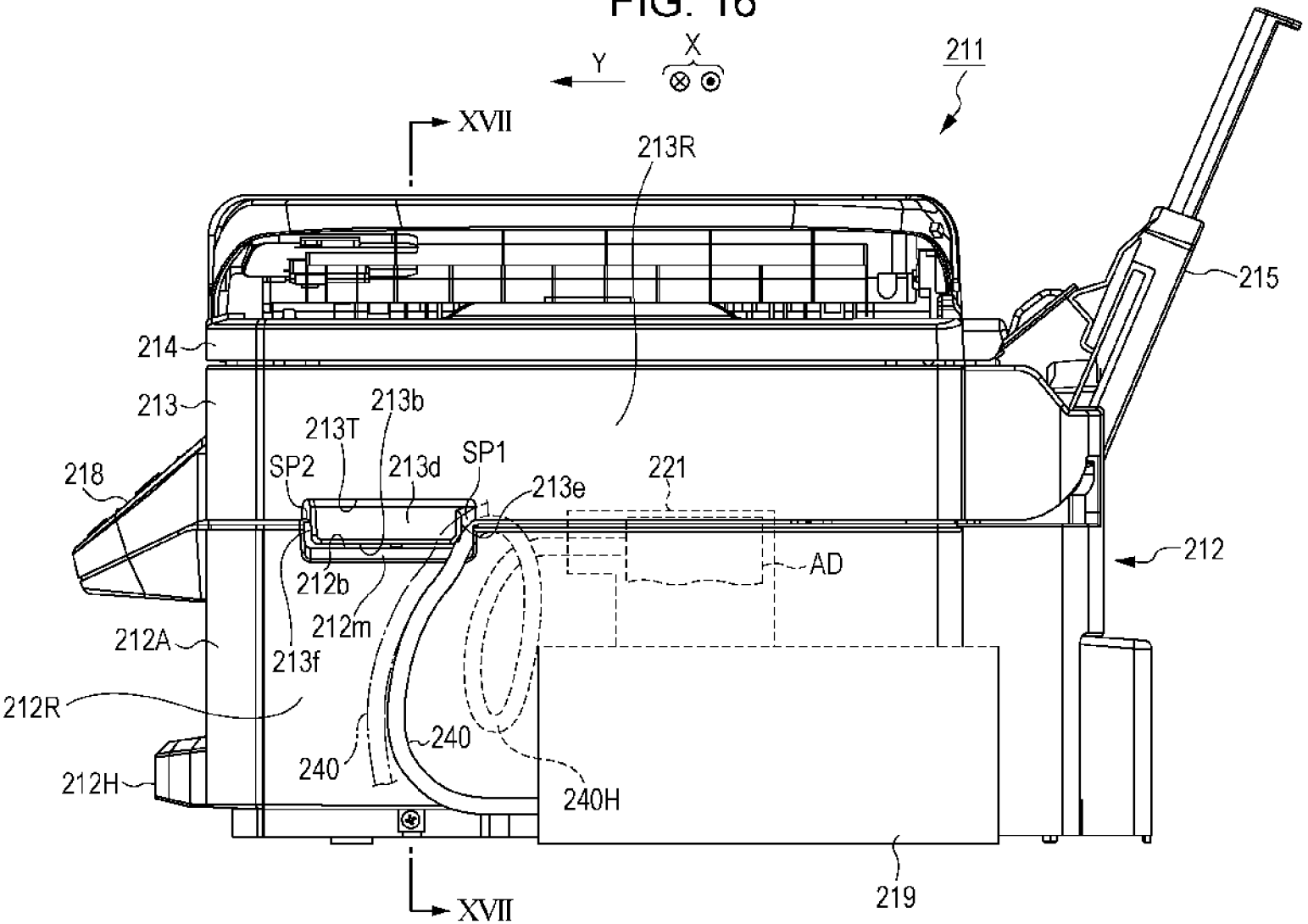
FIG. 16 is a side view of the printer in which the ink supplying tube is disposed according to the sixth embodiment showing that the scanner unit is stacked on the printer unit.

With reference to FIGS. 15A, 15B and 16, the ink supplying tube 240 that supplies ink from the ink tank 219 to the liquid ejection head 222 when the scanner unit 213 is placed to close the opening 212K of the apparatus body 212 (printer unit 212A) in the sixth embodiment will be described.

As shown in FIGS. 15A, 15B and 16, the ink tank 219 that contains ink ejected from the liquid ejection head 222 is disposed outside the housing on the right side of the apparatus body 212 as seen from the downstream side in the sub-scan direction Y. That is, the ink tank 219 is disposed outside the movement area of the carriage 221 and at a position close to a home position HP in the main scan direction X. One end of the ink supplying tube 240 which serves as the flow path of ink in the ink tank 219 is connected to the ink tank 219. The other end of the ink supplying tube 240 is inserted into the apparatus body 212 through the housing gap between the printer unit 212A and the scanner unit 213 from the position close to the home position HP in the main scan direction X of the carriage 221. Then, the ink supplying tube 240 is inserted into the movement area of the carriage 221, which is exposed through the opening 212K formed on the printer unit 212A, and is connected to the relay adapter AD mounted on the carriage 221.

Specifically, the scanner unit 213 is disposed on the upper side of the printer unit 212A and is rotatably supported on the back side of the printer unit 212A. The recessed portion 212*b* are disposed on the front side of the opening 212K at positions that oppose a projecting portion 213*b* that is formed on the scanner unit 213 and protrudes toward the printer unit 212A. As indicated by the bold solid arrow in FIG. 15A, when the scanner unit 213 is placed to close the opening 212K of the printer unit 212A and is stacked on the printer unit 212A, the projecting portion 213*b* is positioned in the recessed portion 212*b* as indicated by the two dotted line in FIG. 15A. Then, a housing gap SP1 that communicates with the opening 212K is formed between the recessed portion 212*b* and the projecting portion 213*b* at least on one side face of the printer unit 212A and the scanner unit 213 as shown in FIG. 16. That is, when the projecting portion 213*b* of the scanner unit 213 is placed to close the opening 212K, the housing gap SP1 is formed by a back wall 213*e* of the projecting portion 213*b* being positioned with a space from the recessed portion 212*b* on the downstream side in the sub-scan direction Y. In this embodiment, the housing gap SP1 is formed on both the printer unit 212A and the scanner unit 213.

In this embodiment, a housing gap SP2 that communicates with the opening 212K is also formed between the recessed portion 212*b* and the projecting portion 213*b* on the front side of the projecting portion 213*b*. That is, when the projecting portion 213*b* of the scanner unit 213 is placed to close the opening 212K, the housing gap SP2 is formed by a front wall 213*f* of the projecting portion 213*b* being positioned with a space from the recessed portion 212*b* on the upstream side in the sub-scan direction Y. The housing gap SP2 is formed on both the printer unit 212A and the scanner unit 213.

In this embodiment, a right wall 213*d* of the projecting portion 213*b* of the scanner unit 213 is positioned left side of the right side face 213R in the main scan direction X so that the right wall 213*d* is depressed from the scanner unit 213 into the inside of the scanner unit 213. That is, when the scanner unit 213 is placed to close the opening 212K, a recessed space that is depressed into the inside of the apparatus body 212 is formed by the right wall 213*d* of the projecting portion 213*b* of the scanner unit 213 on both the right side face 213R of the scanner unit 213 and on the right side face 212R of the printer unit 212A. The recessed space serves as the grip 213T. In other words, the grip 213T is formed as a recessed shape that is provided on each of the printer unit 212A and the scanner unit 213 so as to be connected with each other when the scanner unit 213 is placed to close the opening 212K.

The grip 213T which is formed as a space area of the recessed shape is configured such that the user can put his/her hand (finger) into the grip 213T. Further, the recessed portion 212*b* that forms the recessed shape also includes an inclined surface 212*m* which is inclined so as to increase the opening area of the recessed shape toward the right side face 212R. This allows the user to easily put his/her hand into the grip 213T. Accordingly, the recessed shape formed as the grip 213T provides a wide space area into which the user can put his/her hand.

The space area (recessed shape) formed at the grip 213T communicates with the opening 212K via the housing gap SP1 (SP2). Since the space area (recessed shape) formed at the grip 213T communicates with the space area outside the apparatus body 212, the space area outside the apparatus body 212 that communicates with the space area formed at the grip 213T communicates with the opening 212K via the housing gap SP1 (SP2).

In this embodiment, when the scanner unit 213 is turned by the user to open the opening 212K, the ink supplying tube 240 is inserted into the housing gap SP1 which is formed on the back side of the grip 213T into which the user can put his/her hand, which is on the upstream side in the sub-scan direction Y.

The other end of the ink supplying tube 240 which is inserted into the housing gap SP1 is inserted into the movement area of the carriage 221, which is exposed through the opening 212K formed on the printer unit 212A, with the longitudinal direction extending in the direction along the movement direction of the carriage 221 and is connected to the relay adapters AD mounted on the carriage 221. Accordingly, the portion of the ink supplying tube 240 between the housing gap SP1 and the relay adapter AD in the longitudinal direction which is folded back in the main scan direction X (the portion which is curved in a substantially U-shape in FIG. 15A) is a deformable portion 240H that deforms with the movement of the carriage 221.

As shown in FIG. 15A, the ink supplying tube 240 of this embodiment may be formed by a plurality of tubes connected by the joint 240C in the longitudinal direction. The joint 240C is disposed at a single point or a plurality of points corresponding to the number of tubes to be connected between the ink tank 219 and the carriage 221 so that ink can flow through the connected tubes. In this embodiment, the joint 240C has a through hole and cylindrical portions into which the tube is inserted on each side so that two tubes are jointed with the joint 240C as shown in an example of FIG. 15B, and the tubes are jointed at one point in the deformable portion 240H of the ink supplying tube 240 as shown in FIG. 15A. In FIG. 16, the joint 240C of the ink supplying tube 240 is not shown.

Further, although not shown in the figure, the housing gap SP1 of this embodiment may be formed at the grip 213T on the left side face of the apparatus body 212 (scanner unit 213) which is opposite of the home position HP in the main scan direction X of the carriage 221.

In the case where the grip 213T is formed at the grip 213T on the left side face of the apparatus body 212, the other end of the ink supplying tube 240 which is inserted into the housing gap SP1 is also inserted into the movement area of the carriage 221, which is exposed through the opening 212K, with the longitudinal direction extending in the main scan direction X and is connected to the relay adapters AD mounted on the carriage 221. When the other end of the ink supplying tube 240 is inserted through the grip 213T formed on the left side face, in order to decrease the length of the ink supplying tube 240, the ink tank 219 is preferably disposed at a position opposite of the home position HP (on the left side) of the apparatus body 212 in the main scan direction X of the carriage 221.

Figure 17:
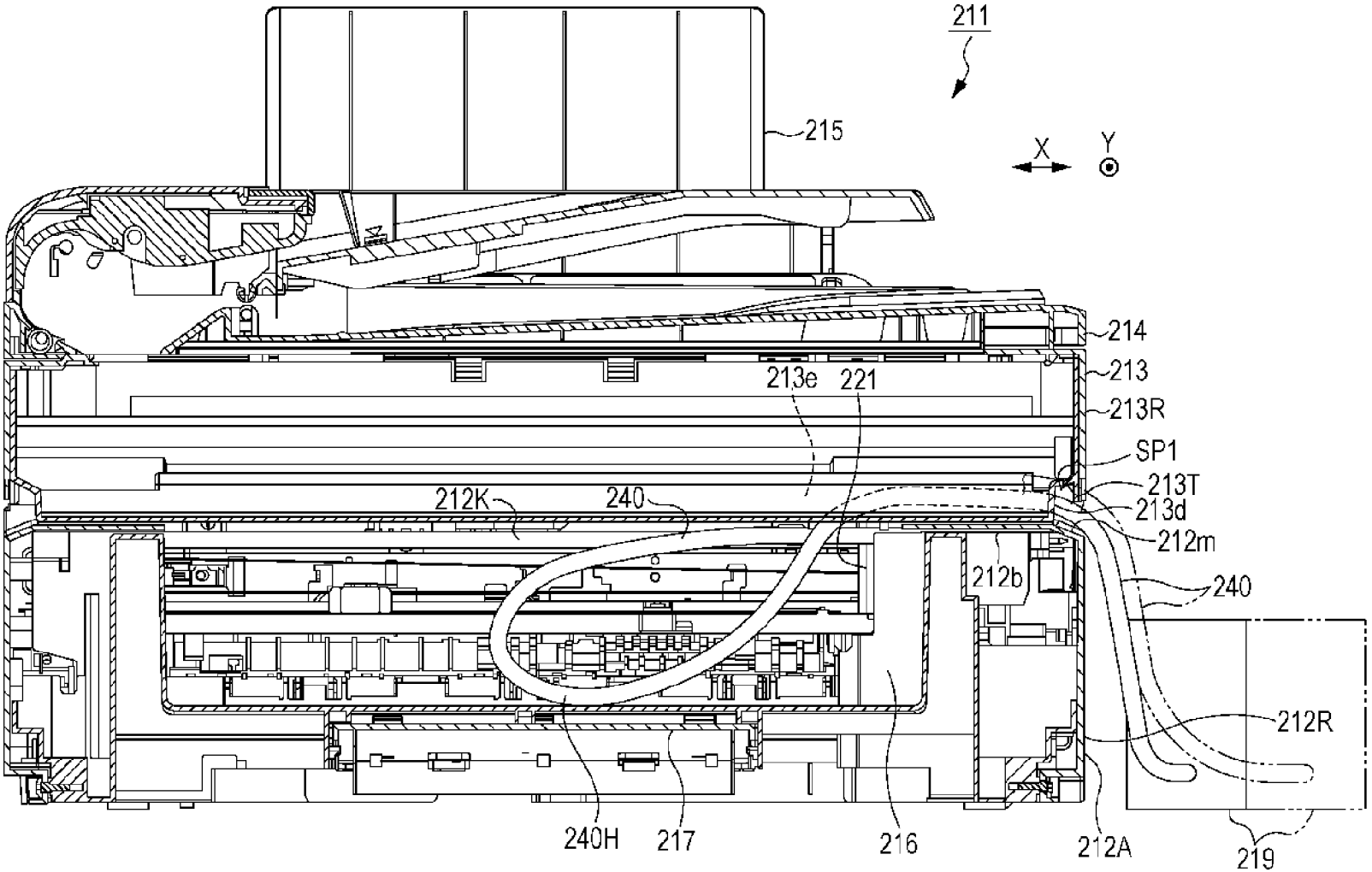
FIG. 17 is a sectional view taken along the line 4-4 of FIG. 16 which shows the printer in which the ink supplying tube is disposed according to the sixth embodiment.

Next, the operation of the printer 211 according to the sixth embodiment will be described with reference to FIGS. 16 and 17. As shown in FIGS. 16 and 17, the other end of the ink supplying tubes 240 is inserted through the housing gap SP1 which is formed between the back wall 213*e* of the projecting portion 213*b* and the recessed portion 212*b* when the scanner unit 213 is placed to close the opening 212K. Then, the other end of the ink supplying tubes 240 inserted through the housing gap SP1 is inserted into the opening 212K that communicates with the housing gap SP1, and is then connected to the carriage 221 (relay adapter AD) whose movement area is exposed through the opening 212K.

In this embodiment, when ink is supplied from the plurality of ink tanks 219 to the carriage 221, the plurality of ink supplying tubes 240 are inserted into the housing gap SP1 formed at the grip 213T. Then, ink is supplied from each of the ink tanks 219 via the respective ink supplying tubes 240. FIGS. 16 and 17 show an example in which ink is supplied from two ink tanks 219 and the second ink supplying tube 240 is inserted into the housing gap SP1 as indicated by the two dotted line. Alternatively, although not shown in the figure, the plurality of ink supplying tubes 240 may be inserted into each of the housing gap SP1 and the housing gap SP2.

According to the sixth embodiment of the ink supplying tube 240, the following effect can be achieved:

(1) Even if the scanner unit 213 is placed to close the opening 212K of the apparatus body 212, the ink supplying tube 240 can be inserted into the opening 212K of the printer unit 212A through the housing gap SP1 (SP2) which is formed on at least one of the printer unit 212A and the scanner unit 213 so that ink can be supplied to the carriage 221. Accordingly, the scanner unit 213 can be remained to close the opening 212K of the printer unit 212A while ink is supplied, for example, from the ink tank 219 which is provided at the apparatus body 212 to the liquid ejection head 222 which is provided in the apparatus body 212.

(2) The ink supplying tube 240 can be easily guided to the opening 212K by inserting the ink supplying tube 240 into the housing gap SP1 formed at the grip 213T which is configured to be gripped by the user with his/her hand to lift the scanner unit 213.

(3) Even if the ink supplying tube 240 is inserted into the grip 213T, the scanner unit 213 can be easily lifted by using the grip 213T since the grip 213T has a wide space area when the scanner unit 213 is placed to close the opening 212K of the printer unit 212A.

(4) A scanner mechanism (for example, a scanner unit) which does not need the supply of ink is disposed in the scanner unit 213 which is displaceable. Accordingly, it is possible to achieve the printer 211 having multiple functions while the printer 211 is capable of supplying ink, for example, from the ink tank 219 provided at the printer unit 212A to the liquid ejection head 222 provided in the printer unit 212A.

(5) The tray housing unit 212H and the operation panel 218 are disposed in the printer unit 212A which is not displaceable. Accordingly, regardless of whether the scanner unit 213 is placed to open or close the opening 212K, the printer 211 that performs ink ejection onto the paper sheet P and output of the paper sheet P can be easily achieved.

(6) The ink supplying tube 240 can be adjusted to an appropriate length for routing of the ink supplying tube 240 by connecting a plurality of tubes by using the joint 240C that connects the tubes.

(7) Ink can be supplied from each of the ink tanks 219 to the liquid ejection head 222 via the number of ink supplying tubes 240 which corresponds to the number of the ink tanks 219.

Seventh Embodiment

Figure 18:
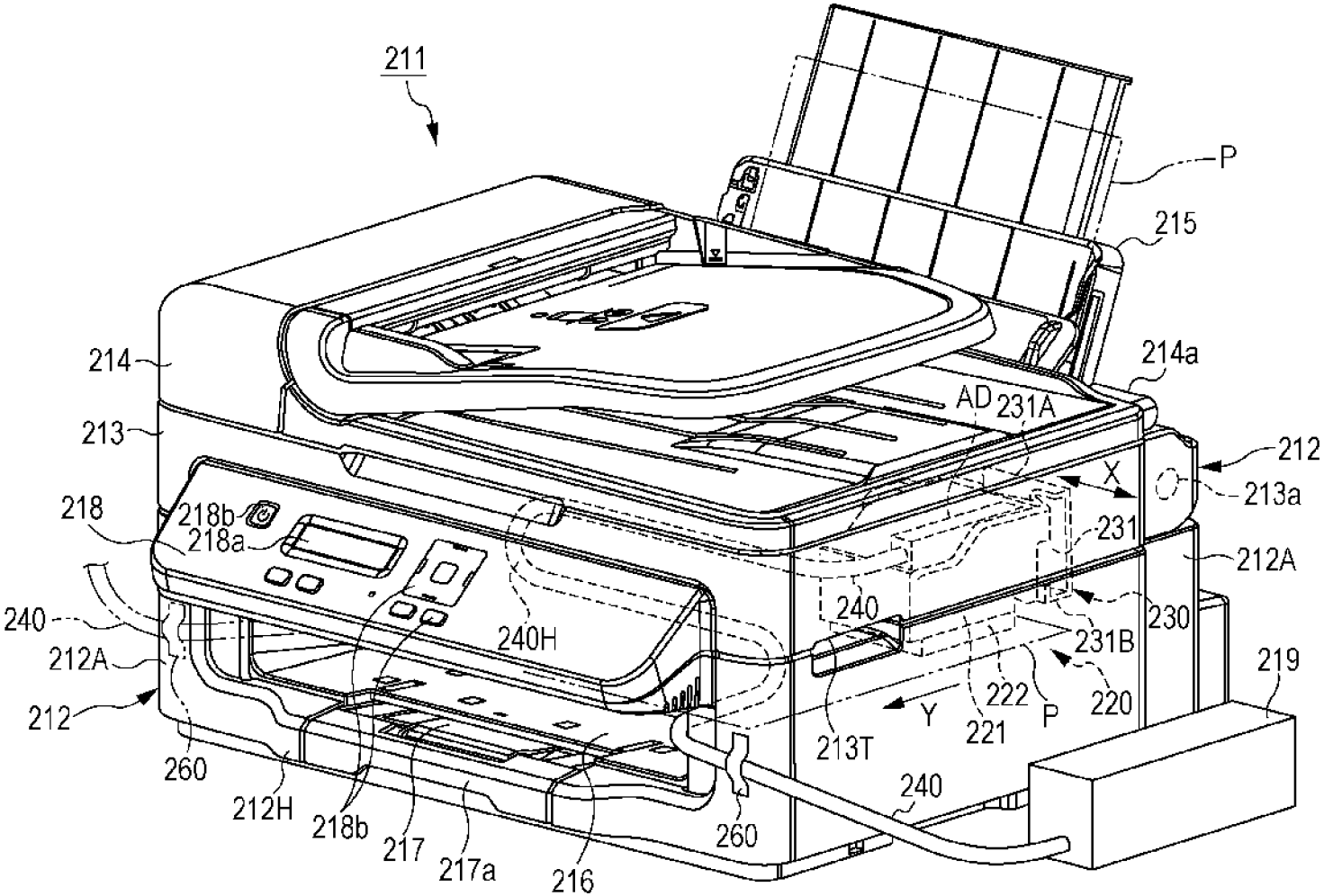
FIG. 18 is a perspective view of the printer in which the ink supplying tube is disposed according to a seventh embodiment.

With reference to FIG. 18, the ink supplying tube 240 that supplies ink from the ink tank 219 to the liquid ejection head 222 when the scanner unit 213 is placed to close the opening 212K of the apparatus body 212 (printer unit 212A) in the seventh embodiment will be described.

In the seventh embodiment, the other end of the ink supplying tube 240 is inserted into the housing gap that communicates with the opening 212K and is disposed at a position other than the grip 213T. In the description of this embodiment, the same elements as those of the sixth embodiment are denoted by the same reference numerals and the description thereof will be omitted as appropriate. Further, the joint 240C of the ink supplying tube 240 is not shown in FIG. 18.

In the printer 211, the opening 212K through which the movement area of the carriage 221 is exposed communicates with the ejection port 216 that is disposed above the stacker 217 onto which the paper sheet P is ejected after being transported under the carriage 221 (see FIG. 17). In other words, the ejection port 216 is disposed on the printer unit 212A and serves as an example of housing gap that communicates with the opening 212K. Accordingly, the other end of the ink supplying tube 240 can be inserted into the space area of the opening 212K through the ejection port 216 which is the housing gap.

As shown in FIG. 18, in this embodiment, the ink supplying tube 240, one end of which is connected to the ink tank 219, is inserted into the printer unit 212A from a position on the right side of the ejection port 216 in the main scan direction X, which is a position close to the home position HP. Then, as indicated by the dotted line in FIG. 18, the ink supplying tube 240 is inserted into the movement area of the carriage 221 and is then connected to the relay adapter AD mounted on the carriage 221.

That is, the other end of the ink supplying tube 240 inserted through the ejection port 216 is inserted into the movement area of the carriage 221 with the longitudinal direction extending in the direction along the movement direction of the carriage 221, and is connected to the relay adapter AD mounted on the carriage 221. Accordingly, the portion of the ink supplying tube 240 between the ejection port 216 and the relay adapter AD in the longitudinal direction which is folded back in the main scan direction X (the portion which is curved in a substantially U-shape in FIG. 18) is a deformable portion 240H that deforms with the movement of the carriage 221.

In this embodiment, as shown in FIG. 18, the ink supplying tube 240 is preferably attached on the housing portion of the printer unit 212A by using a fixture 260 such as an adhesion tape. The ink supplying tube 240 is preferably attached at an end position in the ejection port 216 in the right and left direction which is a direction along the main scan direction X and a position above and spaced from the stacker 217 as far as possible. With this configuration, it is possible to reduce the risk of bothering the ejection operation at the ejection port 216 to eject the paper sheet P onto the stacker 217.

As indicated by the two dotted line in FIG. 18, ink supplying tube 240 may be inserted into the printer unit 212A from a position on the left side of the ejection port 216 and is connected to the relay adapter AD mounted on the carriage 221. In this example, the ink tank 219 is preferably disposed outside the housing on the left side of the apparatus body 212 as seen from the downstream side in the sub-scan direction Y, that is, at a position opposite of the home position HP in the main scan direction X of the carriage 221.

Next, the operation of the printer 211 according to the seventh embodiment will be described. Even if the scanner unit 213 is placed to close the opening 212K of the printer unit 212A, the ink supplying tube 240 which is inserted through the ejection port 216 which is the housing gap can be inserted into the space area of the opening 212K. Accordingly, the other end of the ink supplying tube 240, one end of which is connected to the ink tank 219 disposed outside the apparatus body 212, is connected to the carriage 221 (relay adapter AD) disposed in the apparatus body 212.

According to seventh embodiment, the following effect can be achieved in addition to the effect (2) to (7) of the sixth embodiment:

(8) Even if the scanner unit 213 is placed to close the opening 212K of the printer unit 212A, the ink supplying tube 240 can be inserted into the opening 212K of the printer unit 212A through the ejection port 216 which is the housing gap formed on the printer unit 212A so that ink can be supplied to the carriage 221 disposed in the printer unit 212A. Accordingly, the scanner unit 213 can be remained to close the opening 212K of the printer unit 212A while ink is supplied, for example, from the ink tank 219 which is provided at the printer unit 212A to the liquid ejection head 222 which is provided in the printer unit 212A.

Further, the above embodiments may be modified as follows:

- The recessed shape formed at the grip 213T in the sixth embodiment may not be necessarily formed on both the scanner unit 213 and the printer unit 212A. Further, each of the recesses are not necessarily formed to communicate with each other. For example, the recessed shape may be formed only on the printer unit 212A, or alternatively, the recessed shape may be formed only on the scanner unit 213. In this case, the housing gap SP1 (SP2) is disposed on either the printer unit 212A or the scanner unit 213.
- In the sixth and seventh embodiments, the printer unit 212A may not be necessarily formed by the housing portion which has the tray housing unit 212H protruding in the ejection direction of the paper sheet P. Further, the operation panel 218 may not be necessarily formed by the housing portion which has the inclined surface whose lower end extends farther in the ejection direction of the paper sheet P than the upper end does.
- In the printer 211 of the sixth and seventh embodiments, the cover member that is disposed on the upper side of the printer unit 212A does not necessarily include the scanner unit 213 and the auto document feeder 214, and may be formed as a housing member that covers at least part of the opening 212K.
- The grip 213T of the sixth embodiment may not be necessarily formed on the surface of the apparatus body 212 which extends perpendicular to the main scan direction X. For example, the grip 213T may be formed on the front face on which the ejection port 216 is open.
- In the above embodiments, the relay adapter AD may not be mounted on the carriage 221. That is, a configuration can be possible in which ink is supplied from the ink tank 219 provided outside the printer unit 212A via the ink supplying tube 240 to the liquid ejection head 222 without using the relay adapter AD.
- In the above embodiments, the ink tank 219 may be attached on the apparatus body 212 (printer unit 212A) or the scanner unit 213 by using a fixing member (for example, screws or adhesive). Further, the ink tank 219 may be attached on the right or left side wall or back face as seen from the downstream side (front side) in the sub-scan direction Y. Alternatively, the ink tank 219 may be attached on the upper side of the auto document feeder 214.

In the above embodiments, the ink tanks 19T, 219 which are the liquid container may be of a refillable type, that is, the ink tanks 19T, 219 may be configured to have an inlet port so that ink can be supplied through the inlet port when ink in the ink tanks 19T, 219 is consumed. Alternatively, the ink tanks 19T, 219 may be of a pack-replaceable type, that is, the ink tanks 19T, 219 may be configured to have a bag container that contains ink so that the bag container can be replaced with a new bag when ink is consumed. The ink tanks 19T, 219 may be fixedly attached on the apparatus bodies 12, 212, or alternatively, may be formed as a separate component from the apparatus bodies 12, 212.

Ink contained in the ink tanks 19T, 219 may be a monochrome color. For example, when printing text characters, since the consumption of black ink is large, only black ink can be contained in the ink tanks 19T, 219.

- In the above embodiments, the target is not limited to a sheet of paper, and other materials such as a cloth, resin film, resin sheet and metal sheet may also be used.
- In the above embodiments, the printers 11A, 11B, 211 may be a liquid ejection apparatus that ejects liquid other than ink. The liquid ejected from the liquid ejection apparatus includes the liquid in the form of fine liquid droplets including the droplets in a particle, tear drop or string shape. The liquid as described herein may be any material that can be ejected from liquid ejection apparatus. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Typical examples of liquid include ink as mentioned above, liquid crystal and the like. The ink as described herein includes various liquid components such as general water-based ink, oil-based ink, gel ink and hot melt ink. Specific examples of liquid ejection apparatus may include, for example, liquid ejection apparatuses that eject liquid containing materials such as electrode material and color material in a dispersed or dissolved state, which are used for manufacturing of liquid crystal displays, electro-luminescence (EL) displays, surface emitting displays or color filters. Further, the examples of liquid ejection apparatus may include liquid ejection apparatuses that eject bioorganic materials used for manufacturing biochips, liquid ejection apparatuses that are used as a precision pipette and eject liquid of a sample, textile printing apparatuses and micro dispensers. The examples of liquid ejection apparatus may also include liquid ejection apparatuses that eject lubricant to precision instrument such as a clock or camera in a pin-point manner, liquid ejection apparatuses that eject transparent resin liquid such as ultraviolet cured resin onto a substrate for manufacturing minute hemispheric lenses (optical lenses) used for optical communication elements or the like, and liquid ejection apparatuses that eject acid or alkali etching liquid for etching a substrate or the like.

The entire disclosure of Japanese Patent Application No. 2012-178151 filed on Aug. 10, 2012, No. 2012-178013 filed on Aug. 10, 2012, and No. 2012-178154 filed on Aug. 10, 2012 are expressly incorporated by reference herein.

What is claimed is:

1. A liquid ejection apparatus comprising:

a liquid ejection head that ejects liquid onto a target;

a housing in which a carriage having the liquid ejection head is disposed in a movable manner and an opening is formed so that at least part of a movement area of the carriage is exposed through the opening;

a cover member that is movable relative to the housing;

a liquid container provided outside the housing in a state containing the liquid;

a liquid supplying tube in which the liquid can flow so that the liquid is supplied from the liquid container to the liquid ejection head;

an insertion section formed in the housing that allows the liquid supplying tube to be inserted into the housing; and a front frame disposed inside the housing, spaced apart from the liquid ejection head, and that stands vertically and extends in the direction of movement of the carriage, wherein the liquid supply tube is formed so as to stand vertically along the frame and the insertion section is provided on at least one of the housing and the cover member, wherein, the liquid supply tube being routed along a data line, which is configured for sending a data signal to the liquid ejection head, near a front side of the carriage, the front side being the side on which the target is discharged.

2. The liquid ejection apparatus according to claim 1, wherein the insertion section is provided at a recess that is formed on at least one of the housing and the cover member.

3. The liquid ejection apparatus according to claim 2, wherein a projection is formed on the other of the housing and the cover member at a position that opposes the recess formed on the one of the housing and the cover member when the cover member is displaced from a position to open the opening to a position to close the opening, and the insertion section is provided between the projection and the recess.

4. The liquid ejection apparatus according to claim 3, wherein the cover member is stacked on the housing when the cover member is placed to close the opening, and a grip is provided on at least one of the housing and the cover member, the grip being configured to be gripped by a user with his/her hand to lift the cover member so as to open the opening, and the housing gap is provided at a position of the grip.

5. The liquid ejection apparatus according to claim 4, wherein the grip is formed as a recessed shape on both the housing and the cover member so that each of the recessed shapes communicate with each other when the cover member is displaced to the position to close the opening.

6. The liquid ejection apparatus according to claim 1, wherein the insertion section is provided on at least one of the housing and the cover member on a side face at one end in the movement direction of the carriage.

7. The liquid ejection apparatus according to claim 1, wherein the insertion section is provided on the surface of the housing on which an ejection port for the target is disposed.

8. The liquid ejection apparatus according to claim 1, wherein the liquid supplying tube is inserted into a housing gap that is formed on at least one of the housing and the cover member so as to communicate with the opening when the cover member is displaced from the position to open the opening to the position to close the opening.

9. The liquid ejection apparatus according to claim 1, wherein the cover member includes a scanner mechanism.

10. The liquid ejection apparatus according to claim 1, wherein the liquid supplying tube is formed by a plurality of tubes connected by a joint that connects the tubes.

11. The liquid ejection apparatus according to claim 1, wherein one liquid supplying tube or a plurality of liquid supplying tubes are provided.

12. The liquid ejection apparatus according to claim 1, wherein the liquid supplying tube is fixed to the front frame.

13. The liquid ejection apparatus according to claim 1, wherein the data line for sending the data signal to the liquid ejection head is fixed to the front frame.

14. The liquid ejection apparatus according to claim 13, wherein the liquid supplying tube is fixed to the front frame together with the data line.

15. The liquid ejection apparatus according to claim 1, the data line being mounted to a vertically standing portion of the front frame.

16. The liquid ejection apparatus according to claim 1, the data line is disposed between the front side of the carriage and the liquid supply tube.

17. The liquid ejection apparatus according to claim 1, a vertically standing portion of the front frame being disposed between the front side of the carriage and the liquid supply tube.

* * * * *